US010745223B2

(12) United States Patent
Naoi et al.

(10) Patent No.: US 10,745,223 B2
(45) Date of Patent: Aug. 18, 2020

(54) PAPER FEEDER AND IMAGE FORMING APPARATUS

(71) Applicant: Konica Minolta, Inc., Chiyoda-ku, Tokyo (JP)

(72) Inventors: Shinya Naoi, Toyokawa (JP); Hideyuki Nukumi, Aichi (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/926,613

(22) Filed: Oct. 29, 2015

(65) Prior Publication Data

US 2016/0137438 A1 May 19, 2016

(30) Foreign Application Priority Data

Nov. 13, 2014 (JP) ..... 2014-230470

(51) Int. Cl.
*B65H 1/28* (2006.01)
*G03G 15/00* (2006.01)
(Continued)

(52) U.S. Cl.
CPC ..... *B65H 1/28* (2013.01); *B65H 5/006* (2013.01); *B65H 7/04* (2013.01); *G03G 15/6508* (2013.01);
(Continued)

(58) Field of Classification Search
CPC ... B65H 1/04; B65H 3/44; B65H 1/08; B65H 2405/31; B65H 2405/32; B65H 2405/324;
(Continued)

(56) References Cited

U.S. PATENT DOCUMENTS 6,332,609 B1 * 12/2001 Arakawa ..... B65H 1/04 271/157
8,430,391 B1 * 4/2013 Park ..... B65H 1/26 271/126
2013/0093135 A1 * 4/2013 Park ..... B65H 1/26 271/9.02

FOREIGN PATENT DOCUMENTS

JP 09202462 A 8/1997
JP 2004099275 A 4/2004
(Continued)

OTHER PUBLICATIONS

Machine translation of Japanese Publication No. H09-202462 (Year: 1997).*
(Continued)

*Primary Examiner* — Thomas A Morrison
(74) *Attorney, Agent, or Firm* — Buchanan Ingersoll & Rooney PC

(57) ABSTRACT

A paper feeder includes: first and second accommodation units which are arranged side by side in a casing along a recording paper conveyance direction and in which recording paper is loaded in a specified accommodation orientation; and an erroneous loading detection unit which is provided in a non-loaded region between the first and second accommodation units, detects whether or not the recording paper is loaded, and detects recording paper accommodated in an orientation other than the specified accommodation orientation, wherein the paper feeder can shift a bundle of the recording paper loaded in the second accommodation unit to the first accommodation unit arranged on a downstream side of the recording paper conveyance direction.

13 Claims, 18 Drawing Sheets

(51) Int. Cl.
*B65H 5/00* (2006.01)
*B65H 7/04* (2006.01)

(52) U.S. Cl.
CPC ..... *G03G 15/6511* (2013.01); *B65H 2301/42264* (2013.01); *B65H 2301/42266* (2013.01); *B65H 2511/216* (2013.01); *B65H 2511/51* (2013.01); *B65H 2511/515* (2013.01); *B65H 2513/40* (2013.01); *G03G 2215/00725* (2013.01)

(58) Field of Classification Search
CPC ..... B65H 2405/34; B65H 1/26; B65H 1/28; B65H 1/30; B65H 1/263; B65H 2405/33; B65B 35/04
USPC .... 271/157, 158, 159, 9.07, 9.08; 414/795.8
See application file for complete search history.

(56) References Cited

FOREIGN PATENT DOCUMENTS

| | | | |
|---|---|---|---|
| JP | 2004-262606 | A | 9/2004 |
| JP | 2005-060054 | A | 3/2005 |

OTHER PUBLICATIONS

Machine translation of JP9-202462. (Year: 1997).*
Office Action (Notice of Reasons for Rejection) dated Dec. 2, 2016, by the Japanese Patent Office in corresponding Japanese Patent Application No. 2014-230470, and an English Translation of the Office Action (11 pages).

* cited by examiner

PAPER FEEDER AND IMAGE FORMING APPARATUS

The entire disclosure of Japanese Patent Application No. 2014-230470 filed on Nov. 13, 2014 including description, claims, drawings, and abstract are incorporated herein by reference in its entirety.

BACKGROUND OF THE INVENTION

Field of the Invention

The present invention relates to a paper feeder which stores recording paper provided for image formation, and an image forming apparatus equipped with the paper feeder.

Description of the Related Art

An image forming apparatus has usually been equipped with a paper feeder that is loaded with and stores recording paper used for image formation, where the paper feeder is configured to be inserted/drawn to/from the body of the image forming apparatus to enable replenishment of the recording paper stored in the paper feeder. There has been proposed such paper feeder that is loaded with the recording paper on a movable base plate and moves up/down the base plate according to a volume of the recording paper to be able to accommodate a large volume thereof. There has also been proposed a paper feeder including a first accommodation unit and a second accommodation unit which are arranged side by side with respect to the recording paper so that, once the recording paper in the first accommodation unit is consumed, the recording paper in the second accommodation unit is collectively shifted to the first accommodation unit (refer to JP 2004-262606 A).

According to the paper feeder described in JP 2004-262606 A, the recording paper is loaded in a long edge feed (LEF) orientation according to the shape of the base plate of the first accommodation unit, whereby two bundles of recording paper can be loaded side by side in a conveyance direction to be able to accommodate a large volume of paper. However, the two bundles of recording paper cannot be accommodated when the recording paper is accommodated in an accommodation orientation such as a short edge feed (SEF) orientation (orientation of the recording paper loaded in the paper feeder) that is different from the shape of the base plate. Moreover, the recording paper loaded on the base plate of the first accommodation unit sticks out from the base plate, in which case the bundle of recording paper in the first accommodation unit possibly collapses and cannot be fed into the image forming apparatus when the base plate is moved up.

SUMMARY OF THE INVENTION

In consideration of such problems, an object of the present invention is to provide a paper feeder capable of detecting a poor accommodated state of the recording paper being loaded and an image forming apparatus equipped with the paper feeder.

To achieve the abovementioned object, according to an aspect, a paper feeder reflecting one aspect of the present invention comprises: first and second accommodation units which are arranged side by side in a casing along a recording paper conveyance direction and in which recording paper is loaded in a specified accommodation orientation; and an erroneous loading detection unit which is provided in a non-loaded region between the first and second accommodation units, detects whether or not the recording paper is loaded, and detects recording paper accommodated in an orientation other than the specified accommodation orientation, where the paper feeder can shift a bundle of the recording paper loaded in the second accommodation unit to the first accommodation unit arranged on a downstream side of the recording paper conveyance direction.

In such paper feeder where the specified accommodation orientation in the first and second accommodation units corresponds to a long edge feed orientation in which a short-edge side of the recording paper is parallel to the conveyance direction, the erroneous loading detection unit is preferably arranged in an erroneous loading region in the non-loaded region, the erroneous loading region corresponding to a region of overlap present when the recording paper accommodated in a short edge feed orientation in which a long-edge side of the recording paper is parallel to the conveyance direction is disposed diagonally in each of the first and second accommodation units.

At this time, the erroneous loading detection unit includes a first erroneous loading detection unit provided on a bottom face of the casing and a second erroneous loading detection unit provided on a side wall of the casing, where the first erroneous loading detection unit is preferably provided in the erroneous loading region while the second erroneous loading detection unit is preferably provided in the non-loaded region.

Moreover, the first erroneous loading detection unit is configured to be able to operate in conjunction with the second erroneous loading detection unit, and the second erroneous loading detection unit is provided with a sensor switch that outputs a detection result where, when the first erroneous loading detection unit detects faulty accommodation of the recording paper, the second erroneous loading detection unit is preferably operated in conjunction to cause the sensor switch to output a signal indicating the faulty accommodation.

The aforementioned paper feeder is preferably configured such that the first accommodation unit includes an ascending/descending plate onto which the recording paper is loaded and a lift mechanism which moves up/down the ascending/descending plate, the second accommodation unit includes a shift plate which shifts a bundle of loaded recording paper toward the ascending/descending plate of the first accommodation unit and a slide mechanism which slides the shift plate, the lift mechanism moves up the ascending/descending plate to allow the recording paper loaded in the first accommodation unit to be conveyed, and, when all the recording paper loaded in the first accommodation unit is conveyed, the lift mechanism moves down the ascending/descending plate, and then the slide mechanism moves the shift plate toward the ascending/descending plate to shift the bundle of recording paper loaded in the second accommodation unit to the first accommodation unit.

An image forming apparatus according to an aspect of the present invention preferably comprises: any of the aforementioned paper feeders which can be inserted/drawn to/from the apparatus; a paper feeding mechanism which extracts recording paper stored in a fed paper storage unit; and an image forming unit which forms an image on the recording paper extracted by the paper feeding mechanism.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment of the present invention will be described with reference to the drawings. However, the scope of the invention is not limited to the illustrated examples. Note that when terms indicating specific direction and position (such as "left and right" and "up and down") are used as needed in the following description, a direction orthogonal to the face of FIG. 2 corresponds to a front view where the specific direction and position are determined on the basis of this direction. These terms are used for convenience of description and are not to limit the technical scope of the invention of the present application.

<Overall Structure of Image Forming Apparatus>

Figure 1:
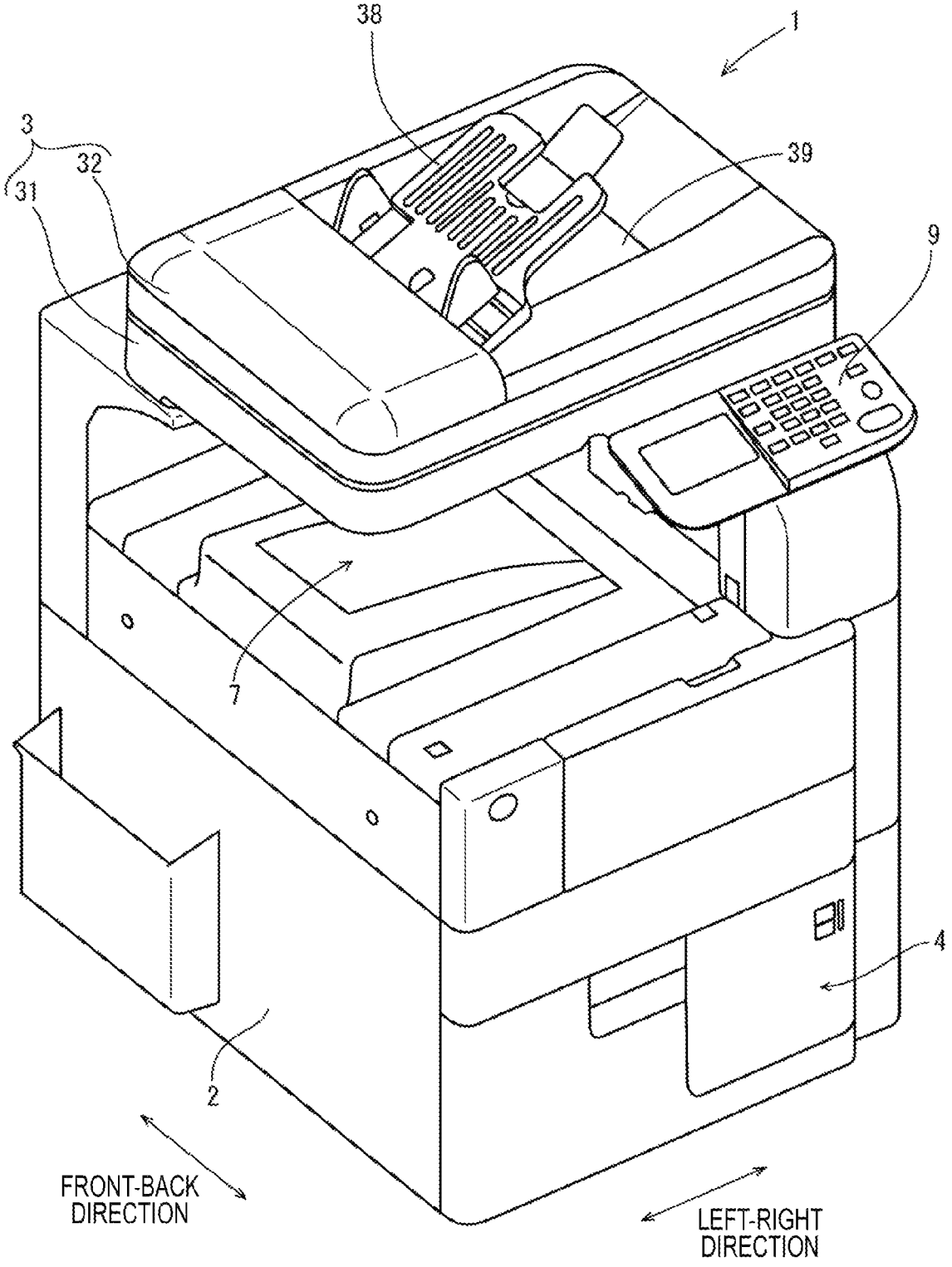
FIG. 1 is an external perspective view illustrating an image forming apparatus according to an embodiment of the present invention.

An overall structure of an image forming apparatus according to an embodiment of the present invention will be described with reference to the drawings. FIG. 1 is an external perspective view illustrating the image forming apparatus of the present invention, and FIG. 2 is a schematic view illustrating the internal structure of the image forming apparatus.

Figure 2:
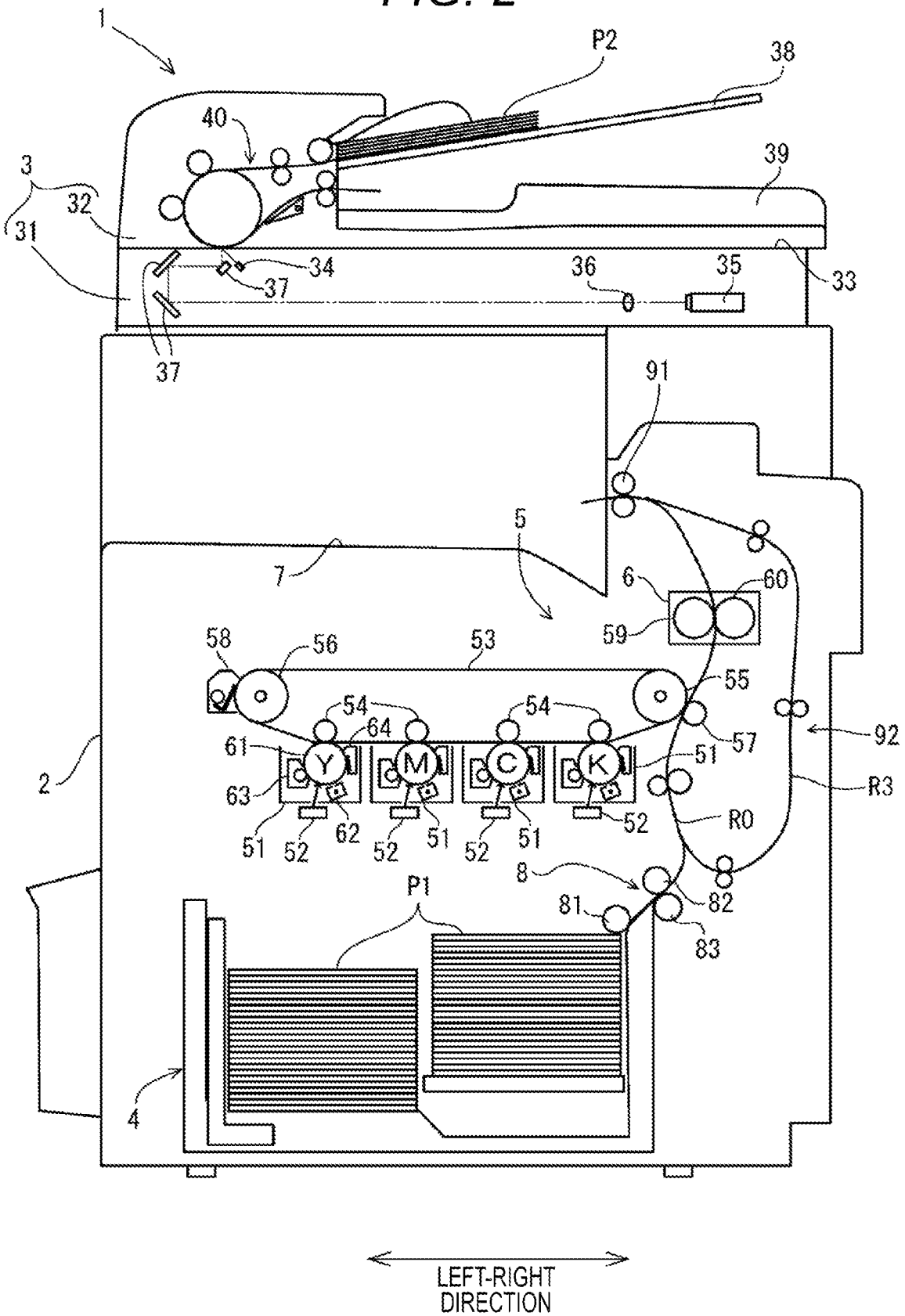
FIG. 2 is a schematic block diagram illustrating the internal structure of the image forming apparatus illustrated in FIG. 1.

As illustrated in FIGS. 1 and 2, an image forming apparatus 1 includes an image reading unit 3 which reads an image from a document P2, a paper feeder 4 which stores recording paper P1 on which an image is formed, a transfer unit 5 which forms a toner image as well as transfers the toner image onto the recording paper P1 fed from the paper feeder 4, a fixing unit 6 which fixes the toner image transferred in the transfer unit 5 to the recording paper P1, a discharge tray 7 to which the recording paper P1 on which an image is formed after fixed by the fixing unit 6 is discharged, and an operation panel 9 which accepts an operation for the image forming apparatus 1. In the image forming apparatus 1, the image reading unit 3 is provided in the upper portion of an apparatus body 2 while the transfer unit 5 is provided below the image reading unit 3.

The discharge tray 7 is provided above the transfer unit 5 in the apparatus body 2 in order to receive the recording paper P1 discharged after an image is recorded thereon by the transfer unit 5 and the fixing unit 6, while the paper feeder 4 arranged below the transfer unit 5 is configured to be inserted/drawn to/from the apparatus body 2. This structure as described later allows the recording paper P1 stored in the paper feeder 4 to be fed into the apparatus body 2 and conveyed upward so that an image is transferred to the recording paper in the transfer unit 5 disposed above the paper feeder 4 and then fixed to the paper in the fixing unit 6, thereby causing the recording paper to be discharged to the discharge tray 7 provided in space (hollow space) between the image reading unit 3 and the transfer unit 5.

The image reading unit 3 provided in the upper portion of the apparatus body 2 includes a scanner unit 31 which reads an image from the document P2 and an auto document feeder (ADF) unit 32 which is provided on top of the scanner unit 31 and conveys the document P2 one sheet at a time to the scanner unit 31. The operation panel 9 is provided at the front face side of the apparatus body 2. A user performs a key operation while looking at a display screen on the operation panel 9 to be able to perform a setting operation on a function selected from among various functions of the image forming apparatus 1 and instruct the image forming apparatus 1 to execute a job.

Next, the internal structure of the apparatus body 2 will be described with reference to FIG. 2. The scanner unit 31 of the image reading unit 3 provided in the upper portion of the apparatus body 2 includes a document stage 33 having a platen glass (not shown) on the top surface side thereof, alight source unit 34 which irradiates the document P2 with light, an image sensor 35 which performs photoelectric conversion on reflected light from the document P2 to form image data, an image forming lens 36 which images the reflected light onto the image sensor 35, and a mirror group 37 which successively reflects the reflected light from the document P2 to be incident on the image forming lens 36. The light source unit 34, the image sensor 35, the image forming lens 36 and the mirror group 37 are provided inside the document stage 33, where the light source unit 34 and the mirror group 37 are configured to be able to move left and right with respect to the document stage 33.

The ADF 32 is provided on the top surface side of the scanner unit 31 to be able to open/close with respect to the document stage 33. The ADF 32 also has a function of bringing the document P2 into close contact with the platen glass (not shown) by covering over the document P2 placed on the platen glass (not shown) of the document stage 33. The ADF 32 includes a document placement tray 38 and a document discharge tray 39.

When the image reading unit 3 configured in this manner reads the document P2 on the platen glass (not shown) of the document stage 33, light is radiated onto the document P2 from the light source unit 34 moving to the right (in a sub-scanning direction). The reflected light from the document P2 is successively reflected by the mirror group 37 moving to the right as the light source unit 34 is, made incident on the image forming lens 36, and imaged on the image sensor 35. The image sensor 35 performs photoelectric conversion for each pixel according to the intensity of the incident light, and generates an image signal (RGB signal) corresponding to the image on the document P2.

When reading the document P2 placed on the document placement tray 38, on the other hand, the document P2 is conveyed to a read position by a document conveying mechanism 40 formed of a plurality of rollers or the like. At this time, the light source unit 34 and the mirror group 37 of the scanner unit 31 are fixed to predetermined positions inside the document stage 33. Accordingly, light is radiated onto the document P2 at the read position by the light source unit 34 so that the reflected light is imaged onto the image sensor 35 through the mirror group 37 and the image forming lens 36 of the scanner unit 31. The image sensor 35 then performs conversion to generate the image signal (RGB signal) corresponding to the image on the document P2. After that, the document P2 is discharged to the document discharge tray 39.

The transfer unit 5 transferring a toner image onto the recording paper P1 includes an imaging unit 51 which generates a toner image of each color including Y (Yellow), M (Magenta), C (Cyan), and K (Key tone), an exposure unit 52 which is provided below each imaging unit 51, an intermediate transfer belt 53 which is in contact with the imaging unit 51 of each color arranged in a horizontal direction to allow the toner image of each color to be transferred from the imaging unit 51 to the belt, a primary transfer roller 54 which is provided at a position facing the upper side of the imaging unit 51 of each color while sandwiching the intermediate transfer belt 53 with the imaging unit 51, a drive roller 55 which turns the intermediate transfer belt 53, a driven roller 56 which is rotated by the rotation of the drive roller 55 propagated thereto through the intermediate transfer belt 53, a secondary transfer roller 57 which is installed at a position facing the drive roller 55 while interposing the intermediate transfer belt 53 therebetween, and a cleaner unit 58 which is installed at a position facing the driven roller 56 while interposing the intermediate transfer belt 53 therebetween.

The imaging unit 51 includes a photosensitive drum 61 which is in contact with an outer peripheral surface of the intermediate transfer belt 53, a charger 62 which electrically charges an outer peripheral surface of the photosensitive drum 61 by corona discharge, a developing unit 63 which causes a toner electrically charged by agitation to adhere to the outer peripheral surface of the photosensitive drum. 61, and a cleaner unit 64 which removes the toner remaining on the outer peripheral surface of the photosensitive drum 61 after transferring the toner image onto the intermediate transfer belt 53. At this time, the photosensitive drum 61 is installed at a position facing the primary transfer roller 54 while interposing the intermediate transfer belt 53 therebetween and rotates in a clockwise direction in FIG. 2. The primary transfer roller 54, the cleaner unit 64, the charger 62, the exposure unit 52 and the developing unit 63 are disposed in this order around the photosensitive drum 61 along the rotational direction of the photosensitive drum 61.

Moreover, the intermediate transfer belt 53 is formed of an endless belt member having conductivity, for example, and is wound around the drive roller 55 and the driven roller 56 without any slack to turn in a counter-clockwise direction in FIG. 2 following the rotation of the drive roller 55. The secondary transfer roller 57, the cleaner unit 58 and the imaging unit 51 of each of Y, M, C, and K are disposed in this order around the intermediate transfer belt 53 along the rotational direction of the intermediate transfer belt 53.

Moreover, the fixing unit 6 fixing the toner image transferred onto the recording paper P1 includes a heater 59 which adds heat to fix the toner image onto the recording paper P1 and a pressurizer 60 which pressurizes the recording paper P1 while sandwiching the recording paper P1 with the heater 59.

The paper feeding mechanism 8 includes a send-out roller 81 which sends out the recording paper P1 stored in the paper feeder 4 from the uppermost layer and a separation roller pair formed of a paper feeding roller 82 and a separating roller 83 which separate the sent-out recording paper P1 one sheet at a time. The recording paper P1 in each paper feeder 4 is sent out one sheet at a time from one in the uppermost layer toward a main conveyance path R0 by the rotational drive of the corresponding send-out roller 81, paper feeding roller 82 and separating roller 83. The main conveyance path R0 is a main path of the recording paper P1 that undergoes a process of image formation (printing). A discharge roller pair 91 discharging the printed recording paper P1 is disposed on a downstream side of the fixing unit 6 formed of the heater 59 and the pressurizer 60 on the main conveyance path R0. The printed recording paper P1 is discharged to the discharge tray 7 by the rotational drive of the discharge roller pair 91.

Moreover, the apparatus body 2 of the image forming apparatus 1 including each unit described above is provided with a circulative conveyance unit 92 which flips over the recording paper P1 after one-sided printing is performed thereon to perform double-sided printing on the paper. The circulative conveyance unit 92 includes a reverse roller pair which reverses the front and back sides of the recording paper P1 after the one-sided printing is performed thereon and a plurality of double side conveyance roller pairs. The circulative conveyance unit 92 reverses the front and back sides of the recording paper P1 after the one-sided printing is performed thereon and conveys it to the main conveyance path R0 again through a circulative conveyance path R3. In this case, the discharge roller pair 91 is configured to be capable of reciprocal rotation to double as the reverse roller pair. By the reciprocal rotation of the discharge roller pair 91, the recording paper P1 can be discharged outside the image forming apparatus 1 and/or returned into the image forming apparatus 1 by switch back (reverse feed). The upstream side of the circulative conveyance path R3 is branched off from between the fixing unit 6 and the discharge roller pair 91 on the main conveyance path R0. The downstream side of the circulative conveyance path R3 joins the upstream side of the transfer unit 5.

A print operation performed by the image forming apparatus 1 will be described briefly. The image forming apparatus 1 starts the print operation upon receiving a start signal or an image signal. Once the print operation is started, the recording paper P1 sent out from the paper feeder 4 by the paper feeding mechanism 8 is conveyed to the image forming unit 5 along the main conveyance path R0. Each of the transfer unit 5 and the fixing unit 6 performs transferring and fixing of an image to the recording paper P1 on the basis of a color electrophotographic method and at the same time adopts, as a method of transferring an image to the recording paper P1, an intermediate transfer method using the intermediate transfer belt 53.

At this time, in the imaging unit 51 for each of Y, M, C, and K colors in the transfer unit 5, the surface of the photosensitive drum 61 electrically charged by the charger 62 is irradiated with laser light from the exposure unit 52, whereby an electrostatic latent image corresponding to an image of each of Y, M, C, and K is formed. A toner electrically charged in the developing unit 63 is transferred to the surface of the photosensitive drum 61 on which the electrostatic latent image is formed, whereby a toner image is formed on the photosensitive drum 61. When brought into contact with the intermediate transfer belt 53, the toner image carried on the surface of the photosensitive drum 61 is transferred to the intermediate transfer belt 53 by electrostatic force of the primary transfer roller 54, so that a toner image in which Y, M, C, and K colors are superimposed on top of one another is formed on the surface of the intermediate transfer belt 53. On the other hand, an untransferred toner remaining on the photosensitive drum 61 after the toner image is transferred to the intermediate transfer belt 53 is scratched off by the cleaner unit 64 and removed from the photosensitive drum 61.

The toner image transferred onto the intermediate transfer belt 53 is moved to a transfer position in contact with the secondary transfer roller 57 by the rotation of the intermediate transfer belt 53 rotated by the drive roller 55 and the driven roller 56, and is transferred onto the recording paper P1 that is conveyed to the transfer position on the main conveyance path R0. An untransferred toner remaining on the intermediate transfer belt 53 after the toner image is transferred onto the recording paper P1 is scratched off by the cleaner unit 58 and removed from the intermediate transfer belt 53. The recording paper P1 onto which the toner image is transferred at the position in contact with the secondary transfer roller 57 is conveyed to the fixing unit 6 formed of the heater 59 and the pressurizer 60.

The recording paper P1 on which an unfixed toner image is formed on one side is subjected to heating by the heater 59 and pressurization by the pressurizer 60 when passing a fixing position of the fixing unit 6, whereby the unfixed toner image is fixed to the surface of the paper. In one-sided printing, the recording paper P1 after the toner image is fixed thereto (after one-sided printing) is discharged to the discharge tray 7 by the discharge roller pair 91. In double-sided printing, on the other hand, the recording paper P1 after the one-sided printing is performed thereon is conveyed to the circulative conveyance path R3 provided for double-sided printing, flipped over, and returned to the main conveyance path R0 again to transfer and fix a toner image onto another side of the recording paper P1 passing each of the transfer unit 5 and the fixing unit 6, and the paper is discharged to the discharge tray 7 thereafter.

<Structure of Paper Feeder>

Figure 3:
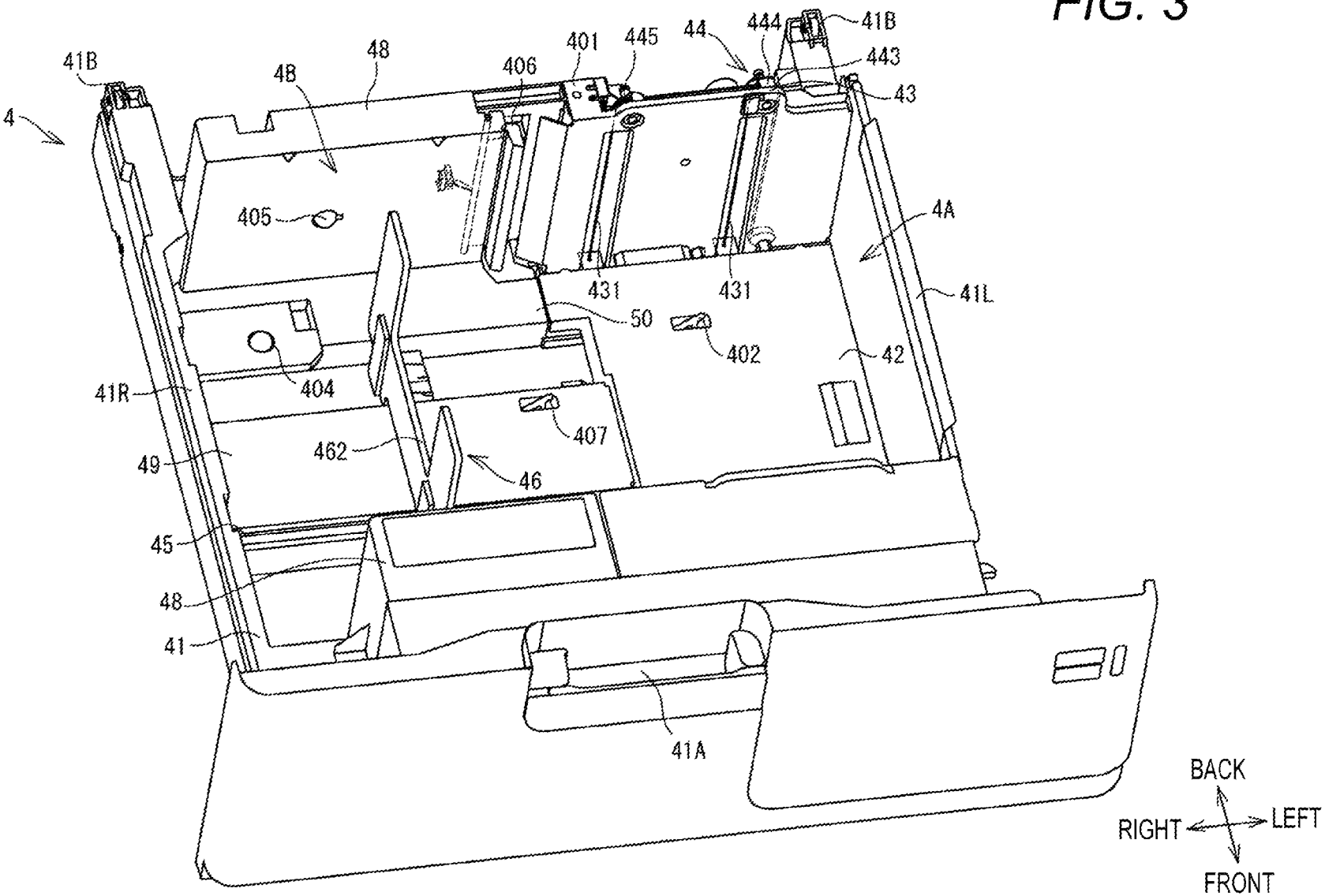
FIG. 3 is an external perspective view illustrating the structure of a paper feeder according to an embodiment of the present invention, as seen from the front.
Figure 4:
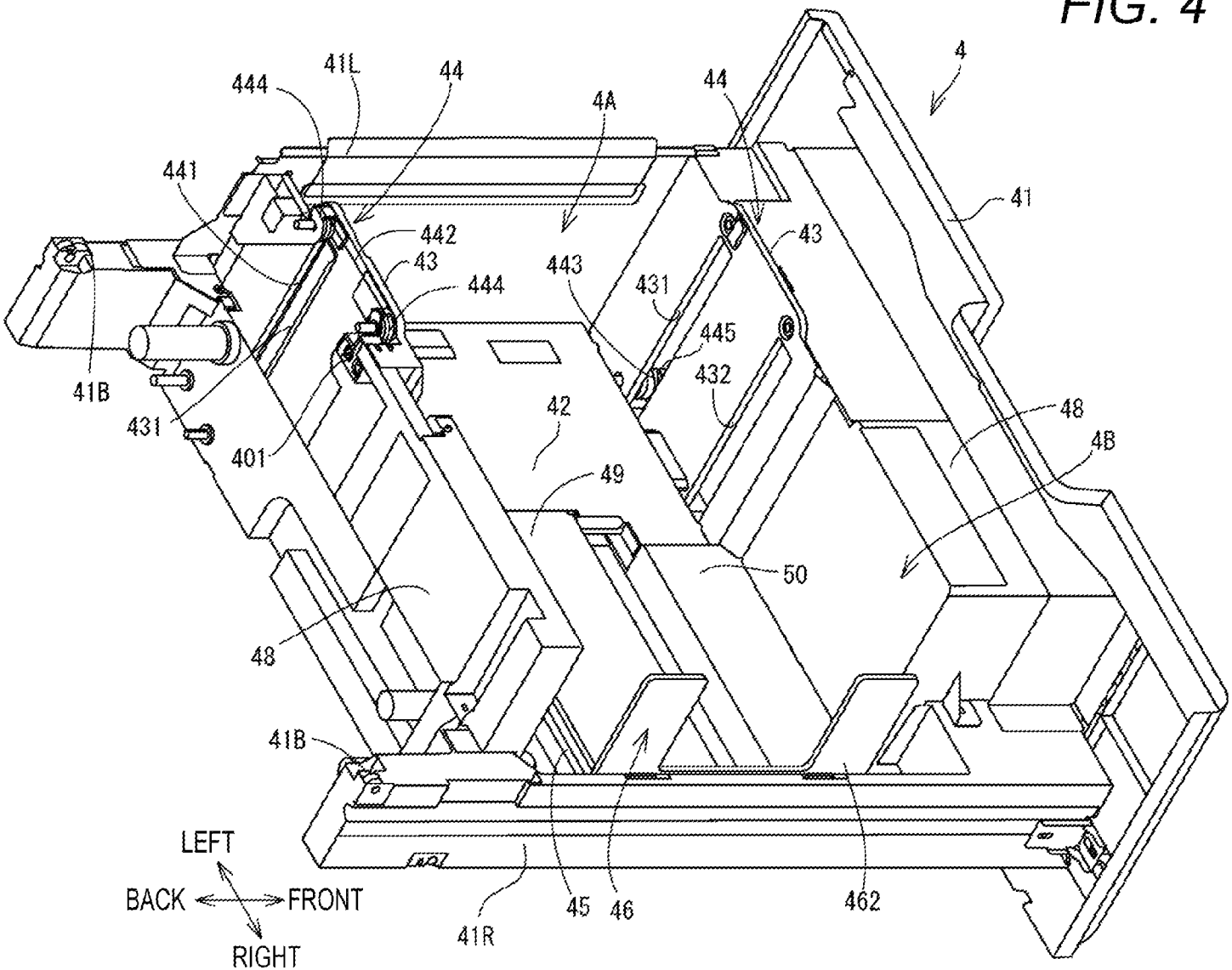
FIG. 4 is an external perspective view illustrating the structure of the paper feeder in FIG. 3, as seen from the back.
Figure 5:
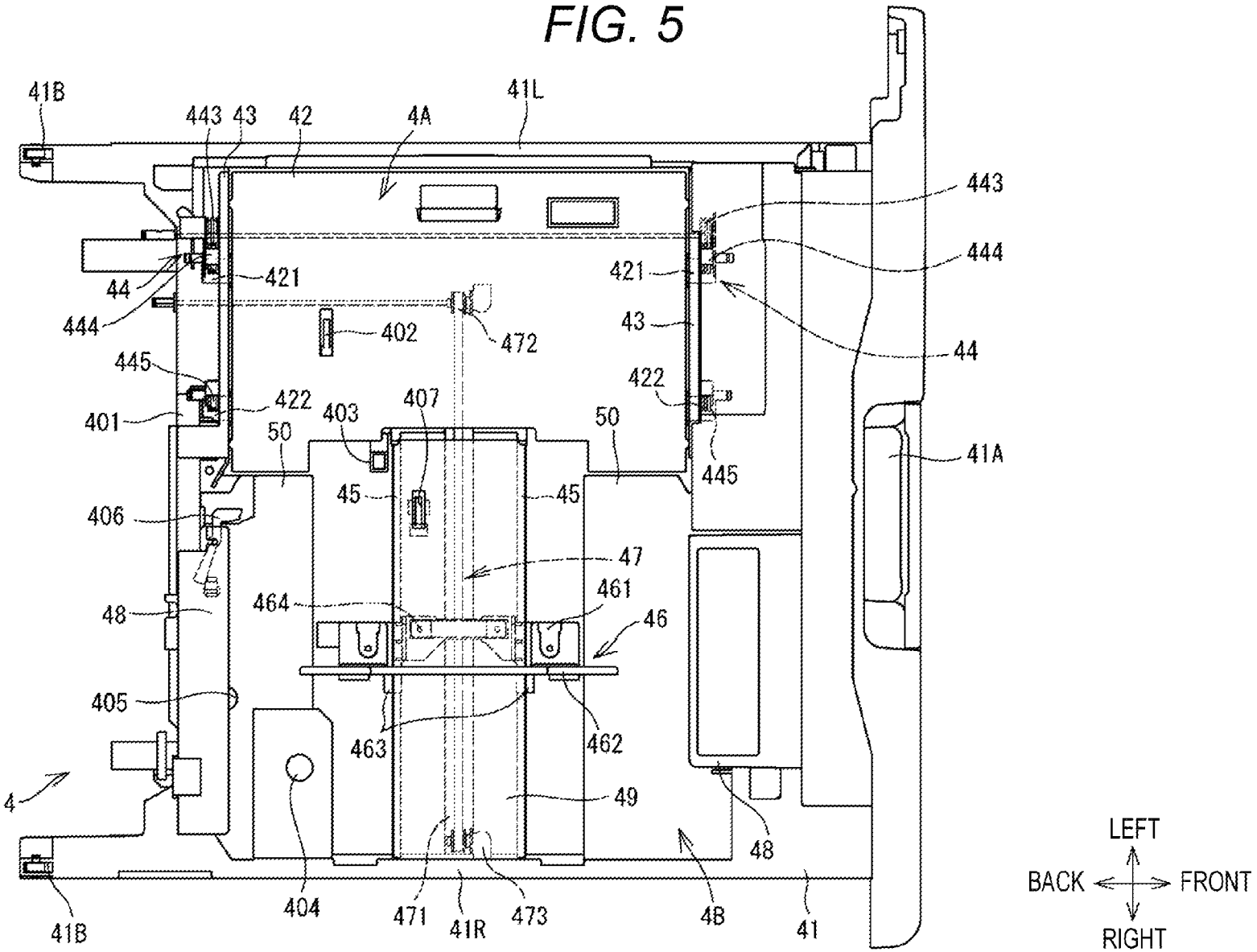
FIG. 5 is a plan view of the paper feeder illustrated in FIG. 3.
Figure 6:
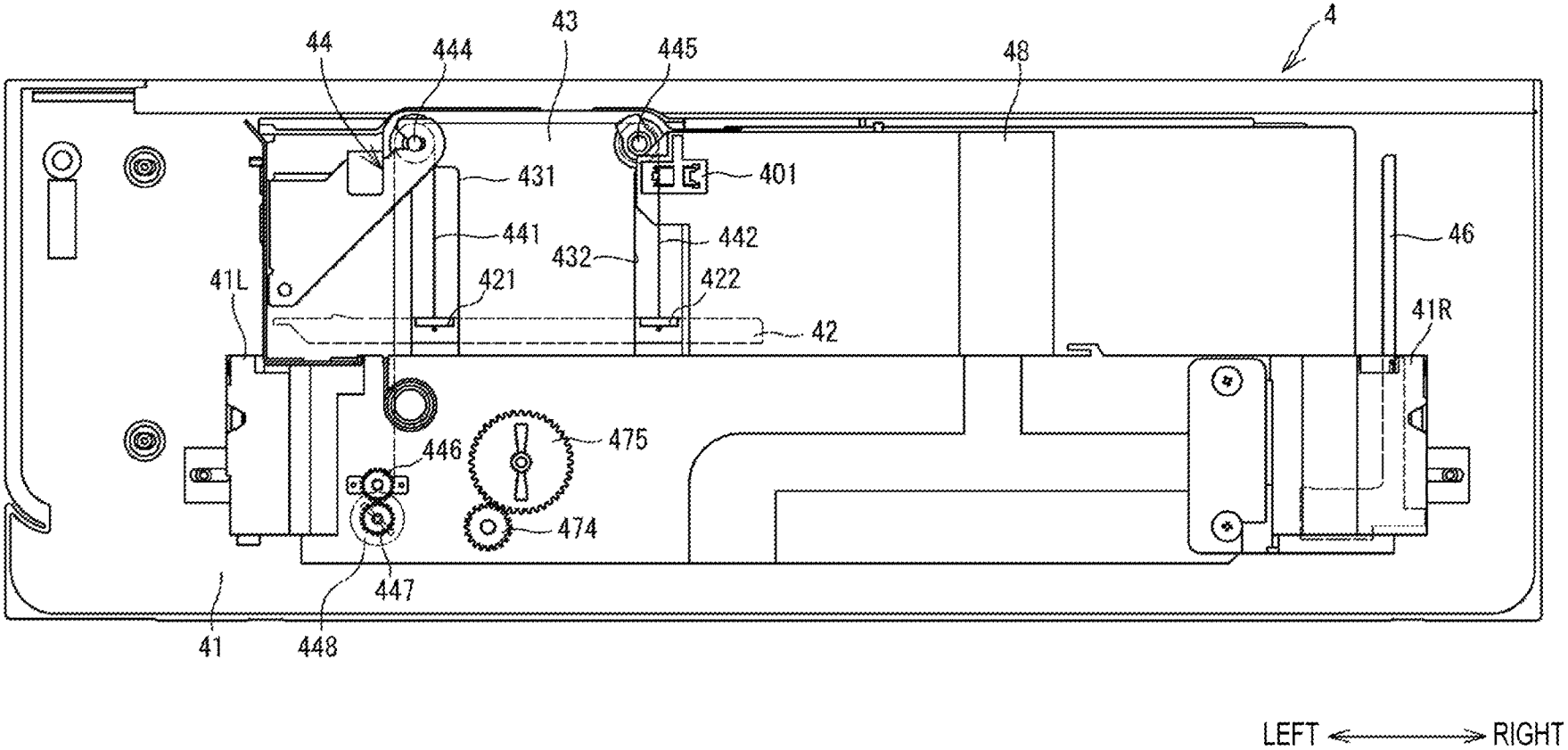
FIG. 6 is a rear view of the paper feeder illustrated in FIG. 3.
Figure 7:
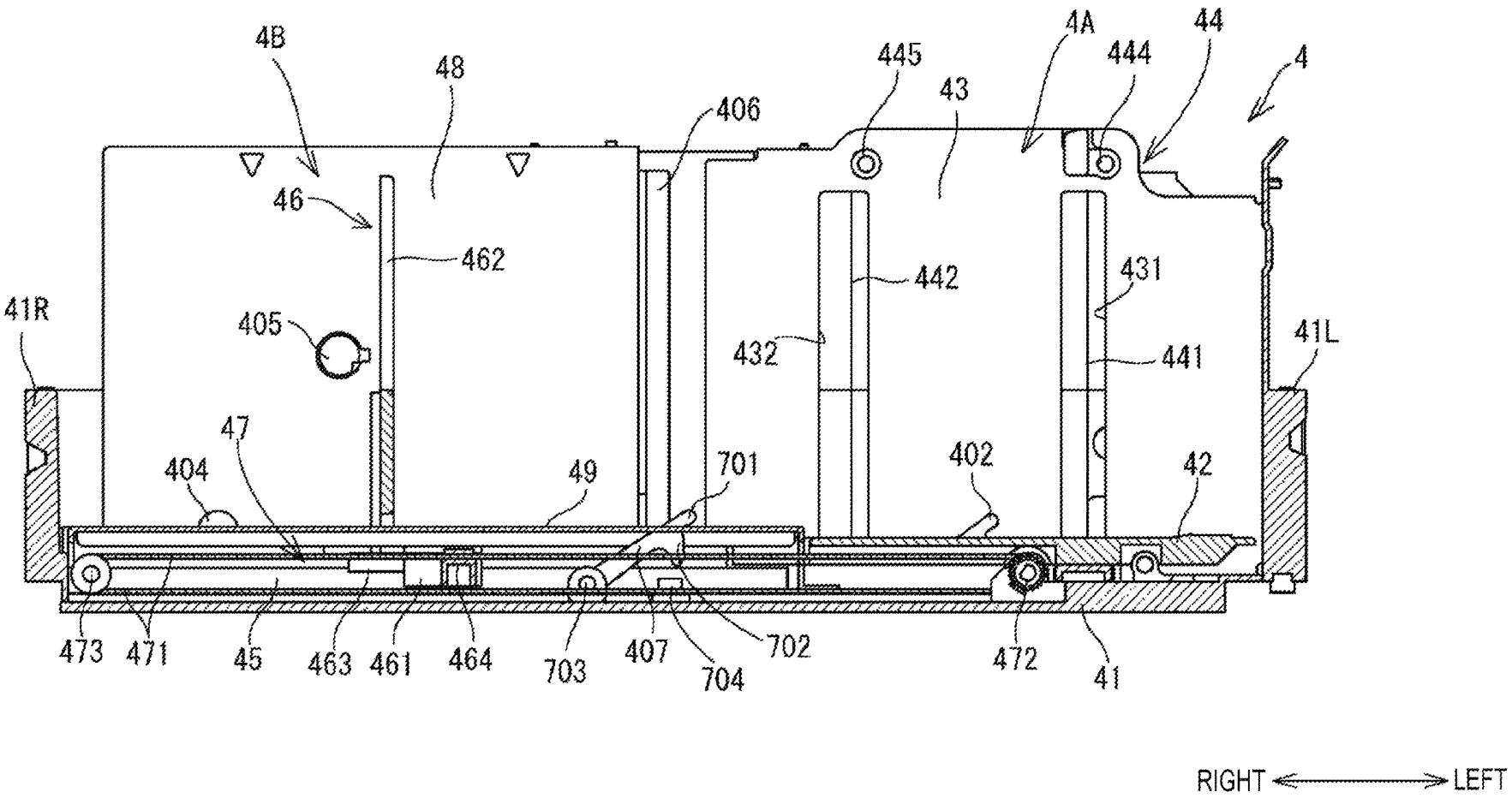
FIG. 7 is a cross-sectional view of the paper feeder illustrated in FIG. 3.

The structure of the paper feeder 4 included in the aforementioned image forming apparatus 1 will now be described. FIGS. 3 and 4 are external perspective views each illustrating the structure of the paper feeder 4, FIG. 5 is a plan view illustrating the structure of the paper feeder 4, FIG. 6 is a rearview illustrating the structure of the paper feeder 4, and FIG. 7 is a cross-sectional view illustrating the structure of the paper feeder 4.

As illustrated in FIGS. 3 to 7, the paper feeder 4 includes a casing 41 that is inserted/drawn to/from the image forming apparatus 1, where the casing 41 includes first and second accommodation units 4A and 4B that are disposed side by side along the conveyance direction of the recording paper P1 and accommodate the recording paper P1 in the long edge feed (LEF) orientation with respect to the conveyance direction. The casing 41 is shaped such that a frame body surrounding the outer periphery of the base plate is erected from the top surface thereof, and includes a pull portion 41A provided on a front face of the frame body and a pulley portion 41B provided on a rear face of the frame body and engaged with a rail (not shown) inside the image forming apparatus 1.

The first accommodation unit 4A includes an ascending/descending plate 42 being the base plate on which the recording paper P1 is mounted and moving up/down inside the casing 41, front and back regulation plates 43 including left and right guide grooves 431 and 432 which horizontally stabilize the position of the ascending/descending plate 42 moving up, a lift mechanism 44 provided at each of front and back of the front and back regulation plates 43 to move up and down the ascending/descending plate 42, and a left (the upstream side of the conveyance direction) side wall 41L of the frame body forming the casing 41.

The second accommodation unit 4B includes rails 45 projecting on the base plate of the casing 41, a shift plate 46 moving left and right while engaged with the rails 45 extending left and right, a slide mechanism 47 including a moving belt 471 which is connected to the shift plate 46, front and back regulation units 48 regulating both edges of the recording paper P1 in the front-back direction (direction perpendicular to the conveyance direction), a right (the downstream side of the conveyance direction) side wall 41R of the frame body forming the casing 41, a cover body 49 covering the slide mechanism 47, and mount stages 50 provided on the base plate of the casing 41 and disposed at front and back of the left side of the casing 41.

The ascending/descending plate 42 includes locking portions 421 and 422 projecting at two sites at each of front and back edges of the ascending/descending plate 42 to lock wires 441 and 442 of the lift mechanism 44. Left and right locking portions 421 and 422 at the front edge of the ascending/descending plate 42 are inserted into the left and right guide grooves 431 and 432 of the front regulation plate 43, whereas the left and right locking portions 421 and 422 at the back edge of the ascending/descending plate 42 are inserted into the left and right guide grooves 431 and 432 of the back regulation plate 43.

Each of the front and back lift mechanisms 44 includes the two wires 441 and 442, one ends of which are connected to the left and right locking portions 421 and 422 provided at the two sites at each of the front and back edges of the ascending/descending plate 42, a take-up pulley 443 connected to another ends of the wires 441 and 442, a driven pulley 444 which stretches the wire 441, and a driven pulley 445 which stretches the wires 441 and 442. The driven pulleys 444 and 445 are positioned above the left and right locking portions 421 and 422, respectively.

One end of the wire 441 is connected to the left locking portion 421 inserted/fitted to the left guide groove 431 of the regulation plate 43, while another end of the wire is connected to the take-up pulley 443 after wound around the driven pulley 444. On the other hand, one end of the wire 442 is connected to the right locking portion 422 inserted/fitted to the right guide groove 432 of the regulation plate 43, and the wire is connected to the take-up pulley 443 after wound around the driven pulleys 445 and 444 in order. The ascending/descending plate 42 is supported while hung by the wires 441 and 442 of the front and back lift mechanisms 44 at four points to be able to maintain a horizontal position when moving up. Moreover, when the lift mechanism 44 moves the ascending/descending plate 42 down toward the bottom of the casing 41, the top surface of the ascending/descending plate 42 is flush with the top surface of each of the cover body 49 and the mount stages 50.

The take-up pulley 443 in the back lift mechanism 44 is provided with an idle gear 446, a damper 447, and a coupling 448. When the paper feeder 4 is stored in the image forming apparatus 1, the coupling 448 is coupled to a coupling (not shown) on the apparatus side provided in a motor (not shown) that is included in the image forming apparatus 1. The rotational driving force of the motor (not shown) inside the image forming apparatus 1 is transmitted to the take-up pulley 443 through the idle gear 446 by the coupling of the coupling (not shown) on the apparatus side and the coupling 448. The motor (not shown) is rotated in the direction in which the wires 441 and 442 are taken up by the take-up pulley 443, namely the direction in which the ascending/descending plate 42 is pulled up.

The idle gear 446 and the damper 447 generate damping force against the rotation of the take-up pulley 443. The damping force of the idle gear 446 and the damper 447 is acted only upon rotation of the take-up pulley 443 in a let-off direction (direction in which the ascending/descending plate 42 is moved down) and is desirably not acted upon rotation in a take-up direction (direction in which the ascending/descending plate 42 is pulled up). Note that a known oil damper or the like can be used as the damper 447 being the damping unit.

The shift plate 46 includes a base end portion 461 fitted between the front and back mount stages 50 and a recording paper pushing portion 462 erected upward from the base end portion 461. The base end portion 461 is provided with front and back rail engaging portions 463 which are engaged with the two rails 45 extending left and right between the front and back mount stages 50, and a belt connection portion 464 connected to the moving belt 471 is provided between the front and back engaging portions 463. Moreover, the rail 45 projects from the base plate of the casing 41 while extending to the left from the right side wall 41R between the front and back mount stages 50.

The slide mechanism 47 extends to the left from the right side wall 41R between the front and back rails 45. The slide mechanism 47 includes a shifting belt 471 connected to the belt connection portion 464 of the shift plate 46, a drive pulley 472 disposed at the bottom of the ascending/descending plate 42 to turn the shifting belt 471, a driven pulley 473 disposed on the side of the right side wall 41R, a belt rotating gear 474 arranged coaxially with the drive pulley 472, and a coupling 475 in mesh with the belt rotating gear 474. The bottom of the shifting belt 471 is embedded in a groove that is dug to extend left and right along the center of the base plate of the casing 41 in the front-back direction.

The belt rotating gear 474 and the coupling 475 are provided behind the back regulation plate 43. When the paper feeder 4 is stored in the image forming apparatus 1, the coupling 475 is coupled to a coupling (not shown) on the apparatus side provided to the motor (not shown) of the image forming apparatus 1. The rotational driving force of the motor (not shown) in the image forming apparatus 1 is transmitted to the drive pulley 472 through the belt rotating gear 474 by the coupling between the coupling (not shown) on the apparatus side and the coupling 475.

The top surface of the cover body 49 is flush with the top surface of each of the front and back mount stages 50, whereby the recording paper P1 can be accommodated horizontally in the second accommodation unit 4B. Moreover, the engaging portions 463 are engaged with the rails 45 while at the same time the base end portion 461 is disposed between the front and back mount stages 50, whereby a displacement of the shift plate 46 in the front-back direction can be prevented when the plate is moved left and right. On the other hand, the cover body 49 covers the rails 45, the shifting belt 471 and driven pulley 473 of the slide mechanism 47, and the belt connection portion 464 of the shift plate 46, whereby a displacement of the shift plate 46 in a vertical direction can be prevented when the plate is moved left and right.

The first accommodation unit 4A of the paper feeder 4 includes an upper limit detection sensor 401 which detects whether or not the ascending/descending plate 42 is at an upper limit position, a recording paper detection sensor 402 which detects whether or not the recording paper P1 is loaded onto the ascending/descending plate 42 at a lower limit position, and a shift plate detection sensor 403 which detects whether or not the shift plate 46 is at a shift position near the right edge of the ascending/descending plate 42. Moreover, the second accommodation unit 4B of the paper feeder 4 includes a recording paper detection sensor 404 which detects whether or not the recording paper P1 is loaded in the second accommodation unit 4B, and a load detection sensor 405 which detects the load of the recording paper P1 accommodated.

The upper limit detection sensor 401 provided on a back side wall of the casing 41 is formed of an optical sensor including light receiving/emitting elements, for example, and is configured to detect that the ascending/descending plate 42 is at the upper limit position when light from the light emitting element is shielded by a light shielding plate provided in either one of the left and right locking portions 421 and 422. The recording paper detection sensor 402 is formed of a contact sensor disposed to be able to sway a recording paper detection unit (filler) projecting from an opening 423 of the ascending/descending plate 42 at the lower limit position, for example, and detects whether or not the recording paper P1 is loaded onto the ascending/descending plate 42 when the ascending/descending plate 42 at the lower limit position. The shift plate detection sensor 403 is formed of an optical sensor including light receiving/emitting elements, for example, and detects that the recording paper pushing portion 462 of the shift plate 46 is near the right edge of the ascending/descending plate 42 when light is shielded by the base end portion 461 of the shift plate 46.

The recording paper detection sensor 404 is formed of a contact sensor including a recording paper detection unit that moves vertically, for example, and is configured such that the recording paper detection unit projects from the top surface of the mount stage 50 when the recording paper P1 is not accommodated. The recording paper detection sensor 404 detects that the recording paper P1 is accommodated when the recording paper detection unit is pressed by the recording paper P1 being loaded and lowered below the mount stage 50. The load detection sensor 405 is formed of a contact sensor similar to the recording paper detection sensor 404, for example, and is configured such that a recording paper detection unit projects from the regulation unit 48 of the casing 41. The recording paper detection unit projects inside the second accommodation unit 4B when the load of the recording paper P1 is below an installation position, in which case the load detection sensor 405 detects that a small volume of recording paper P1 is loaded.

Figure 8A:
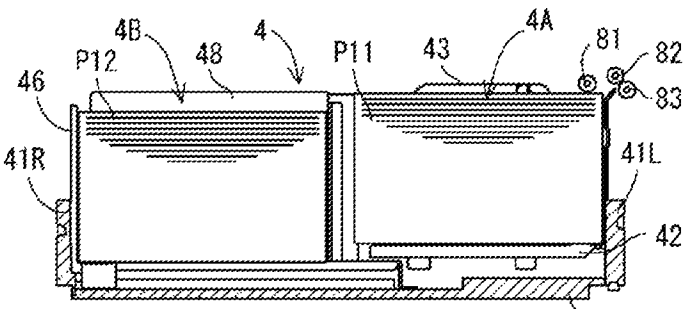
FIGS. 8A to 8F are schematic cross-sectional views of the paper feeder illustrated in FIG. 3, each of FIGS. 8A to 8F illustrating the operation of each unit of the paper feeder.

An operation of shifting the recording paper P1 in the paper feeder 4 will be described below with reference to FIGS. 8A to 8F. As illustrated in FIG. 8A, the recording paper P1 is loaded in the first and second accommodation units 4A and 4B of the paper feeder 4. Note that in the following description, a bundle of the recording paper P1 loaded in the first accommodation unit 4A will be called a bundle of recording paper P11 while a bundle of the recording paper P1 loaded in the second accommodation unit 4B will be called a bundle of recording paper P12. When the bundle of recording paper P11 is loaded in the first accommodation unit 4A, the ascending/descending plate 42 is moved up by the lift mechanism 44 to press-fit the uppermost recording paper P1 against the send-out roller 81. As a result, the uppermost sheet of recording paper P1 in the bundle of recording paper P11 is sent out by the send-out roller 81 and conveyed one sheet at a time by the paper feeding roller 82 and the separating roller 83.

Figure 8B:
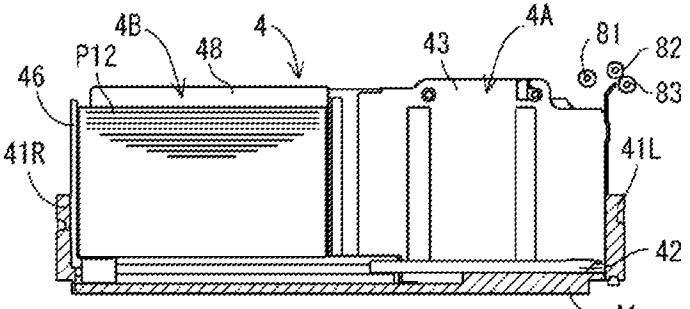
Figure 8C:
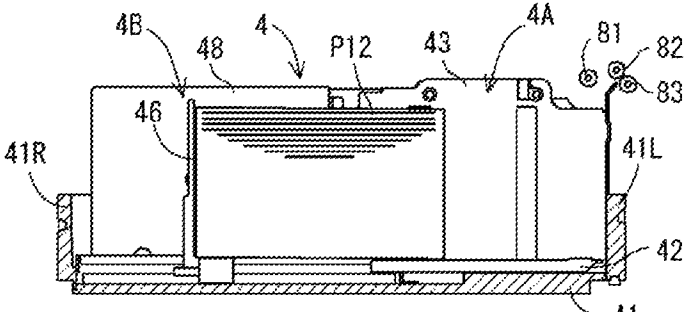
Figure 8D:
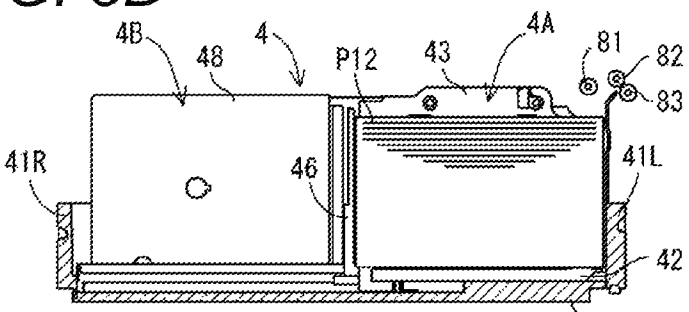

Once all the recording paper P1 in the bundle of recording paper P11 loaded in the first accommodation unit 4A is conveyed into the image forming apparatus 1, the lift mechanism 44 stops moving up the ascending/descending plate 42 and causes the ascending/descending plate 42 to move down by its own weight as illustrated in FIG. 8B. When the ascending/descending plate 42 moves down to the lower limit position of the first accommodation unit 4A, the slide mechanism 47 moves the shift plate 46 horizontally toward the first accommodation unit 4A (to the left) as illustrated in FIG. 8C. Accordingly, as illustrated in FIG. 8D, the bundle of recording paper P12 in the second accommodation unit 4B is pushed out toward the first accommodation unit 4A by the recording paper pushing portion 462 of the shift plate 46 and collectively shifted onto the ascending/descending plate 42 of the first accommodation unit 4A.

Figure 8E:
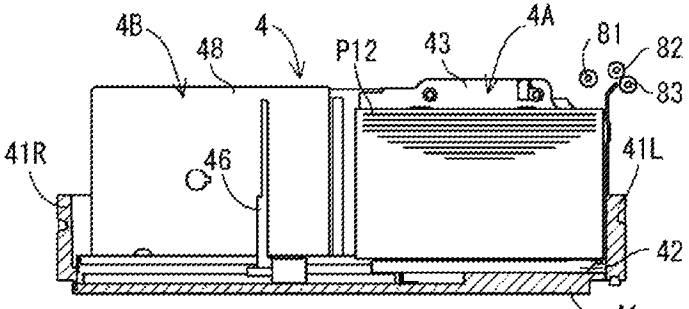
Figure 8F:
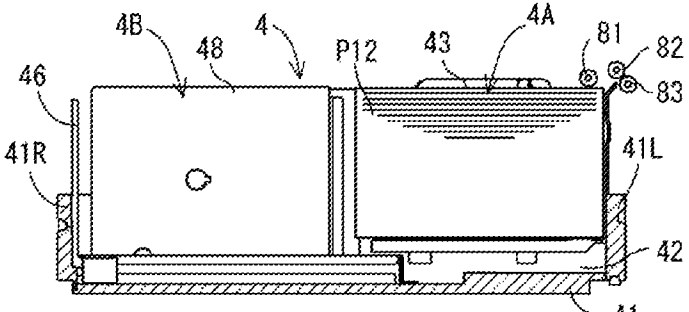

When the shift plate 46 reaches the right edge of the ascending/descending plate 42 causing the bundle of recording paper P12 in the second accommodation unit 4B to be loaded onto the ascending/descending plate 42, the slide mechanism 47 moves the shift plate 46 horizontally toward the right side wall 41R of the casing 41 (to the right) as illustrated in FIG. 8E. The shift plate 46 stops once in contact with the right side wall 41R, whereby the recording paper P1 can now be loaded in the second accommodation unit 4B as illustrated in FIG. 8F. In the first accommodation unit 4A, on the other hand, the ascending/descending plate 42 is moved up by the lift mechanism 44 to press-fit the uppermost recording paper P1 in the bundle of recording paper P12 against the send-out roller 81.

Figure 9A:
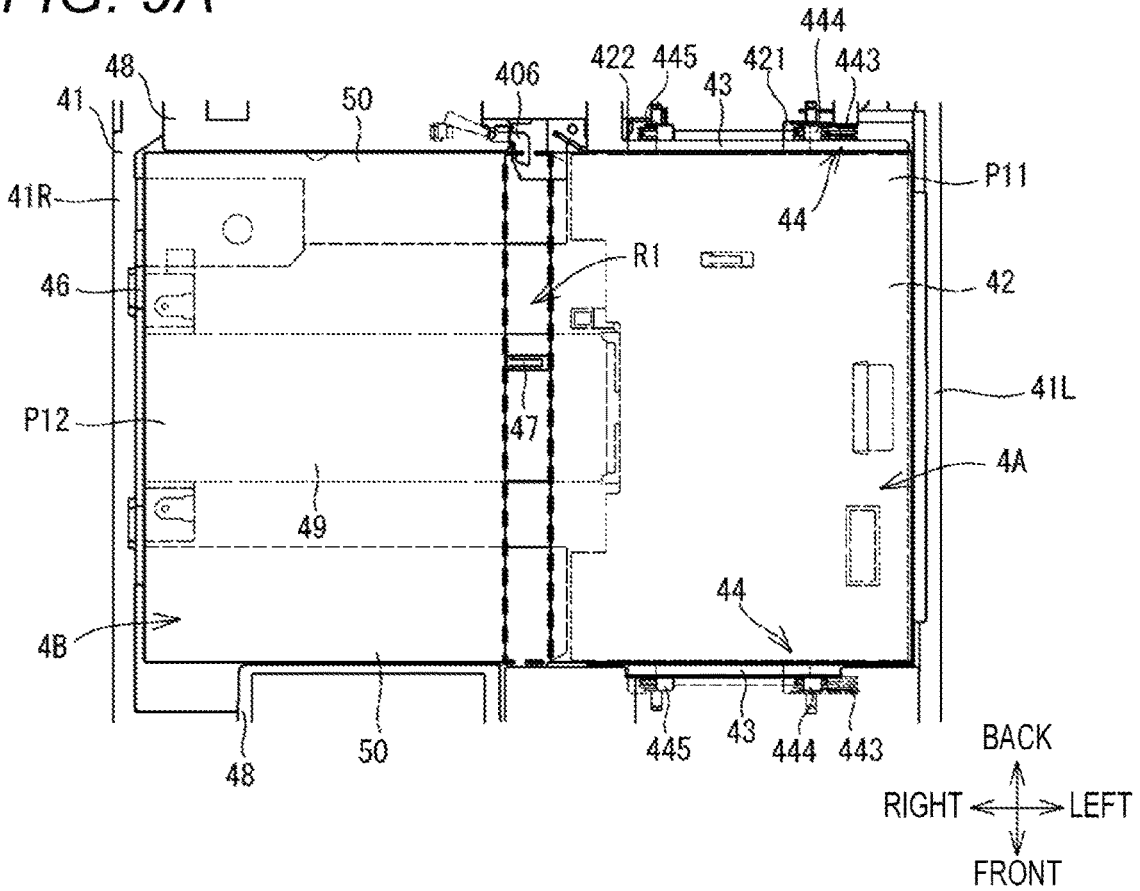
FIGS. 9A and 9B are plan views of the paper feeder provided to describe a non-loaded region, FIG. 9A illustrating the non-loaded region and FIG. 9B illustrating an erroneous loading region.

As illustrated in FIG. 9A, the paper feeder 4 is configured to load the recording paper P1 in each of the first and second accommodation units 4A and 4B of the casing 41 in the long edge feed (LEF) orientation. That is, the bundle of recording paper P11 is loaded onto the first accommodation unit 4A such that a long side of the recording paper P1 faces the left side wall 41L of the casing 41, whereas the bundle of recording paper P12 is loaded onto the second accommodation unit 4B such that the long side of the recording paper P1 faces the right side wall 41R of the casing 41. A region (non-loaded region) R1 not overlapped by the recording paper P1 exists between the first and second accommodation units 4A and 4B in the casing 41 when the recording paper P1 is loaded in each of the first and second accommodation units 4A and 4B in the long edge feed orientation.

Figure 9B:
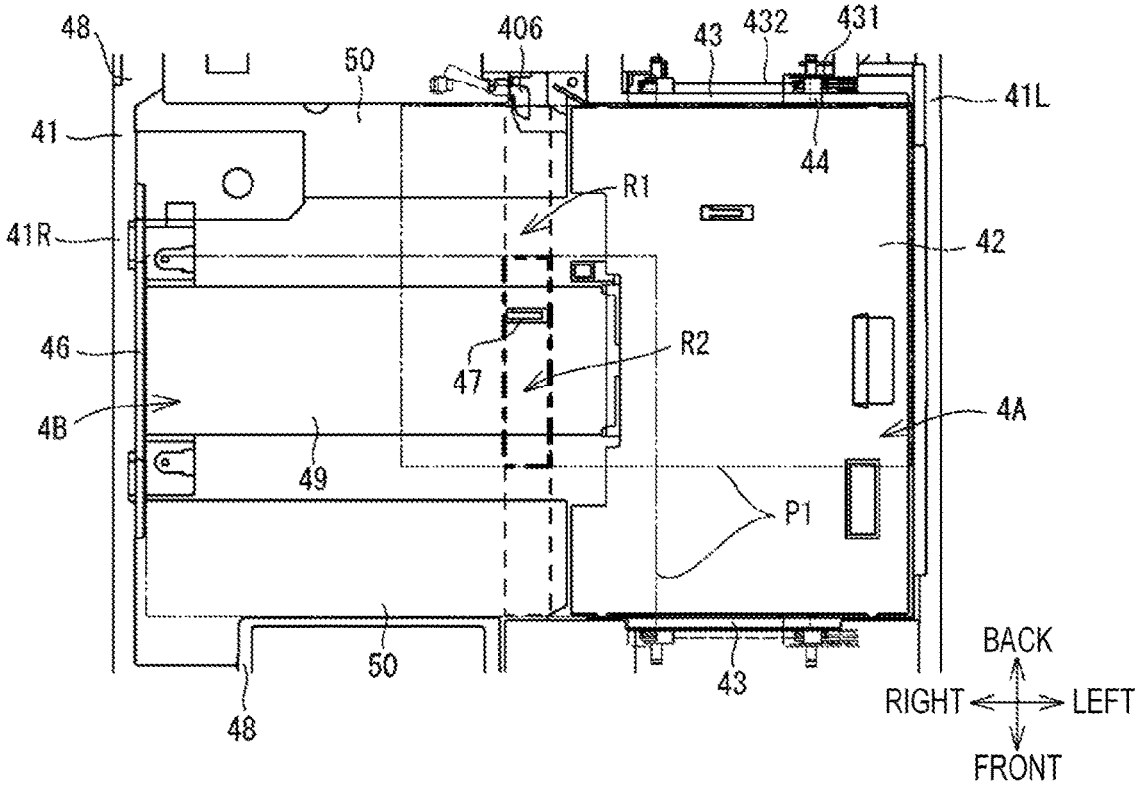

When the recording paper P1 is accommodated not in the long edge feed (LEF) orientation being the specified accommodation orientation but in a short edge feed (SEF) orientation in the paper feeder 4, the recording paper P1 is loaded onto the non-loaded region R1 as illustrated in FIG. 9B. That is, when the recording paper P1 is accommodated in the short edge feed (SEF) orientation in the paper feeder 4, the recording paper P1 is always loaded in a region (erroneous loading region) R2 on the inner side of the non-loaded region R1 as illustrated in FIG. 9B. The erroneous loading region R2 is a region of overlap present when the recording paper P1 accommodated in the short edge feed orientation is diagonally disposed in each of the first and second accommodation units 4A and 4B.

The erroneous loading region R2 is a region in which no paper is loaded when the recording paper P1 is loaded in the specified accommodation orientation, and is a region in which the paper is always loaded when the recording paper P1 is loaded in an orientation (erroneous loading orientation) intersecting with the specified accommodation orientation. That is, the erroneous loading region R2 is a region enclosed by the right edge of the recording paper P1 loaded in the first accommodation unit 4A in the specified accommodation orientation, the left edge of the recording paper P1 loaded in the second accommodation unit 4B in the specified accommodation orientation, the rear edge of the recording paper P1 accommodated in the front side (toward the front regulation plate 43 or front regulation unit 48) of the casing 41 in the erroneous loading orientation, and the front edge of the recording paper P1 accommodated in the back side (toward the back regulation plate 43 or back regulation unit 48) of the casing 41 in the erroneous loading orientation.

In order to detect faulty accommodation (erroneous loading) of the recording paper P1, the paper feeder 4 includes a tilt detection sensor (second erroneous loading detection unit) 406 which detects whether or not either one of the bundles of recording paper P11 and P12 loaded in the first and second accommodation units 4A and 4B is tilted in the non-loaded region R1, and an accommodation orientation detection sensor (first erroneous loading detection unit) 407 which detects whether or not the accommodation orientation of the recording paper P1 is normal. The tilt detection sensor 406 is supported about a shaft by the regulation unit 48 of the first accommodation unit 4A, and a recording paper detection unit 601 in contact with the tilted recording paper P1 extends vertically to be parallel with the right edge of the regulation plate 43. The accommodation orientation detection sensor 407 includes, in the erroneous loading region R2 at the bottom side of the casing 41, a recording paper detection unit 701 which detects whether or not the recording paper P1 is loaded.

Figure 10:
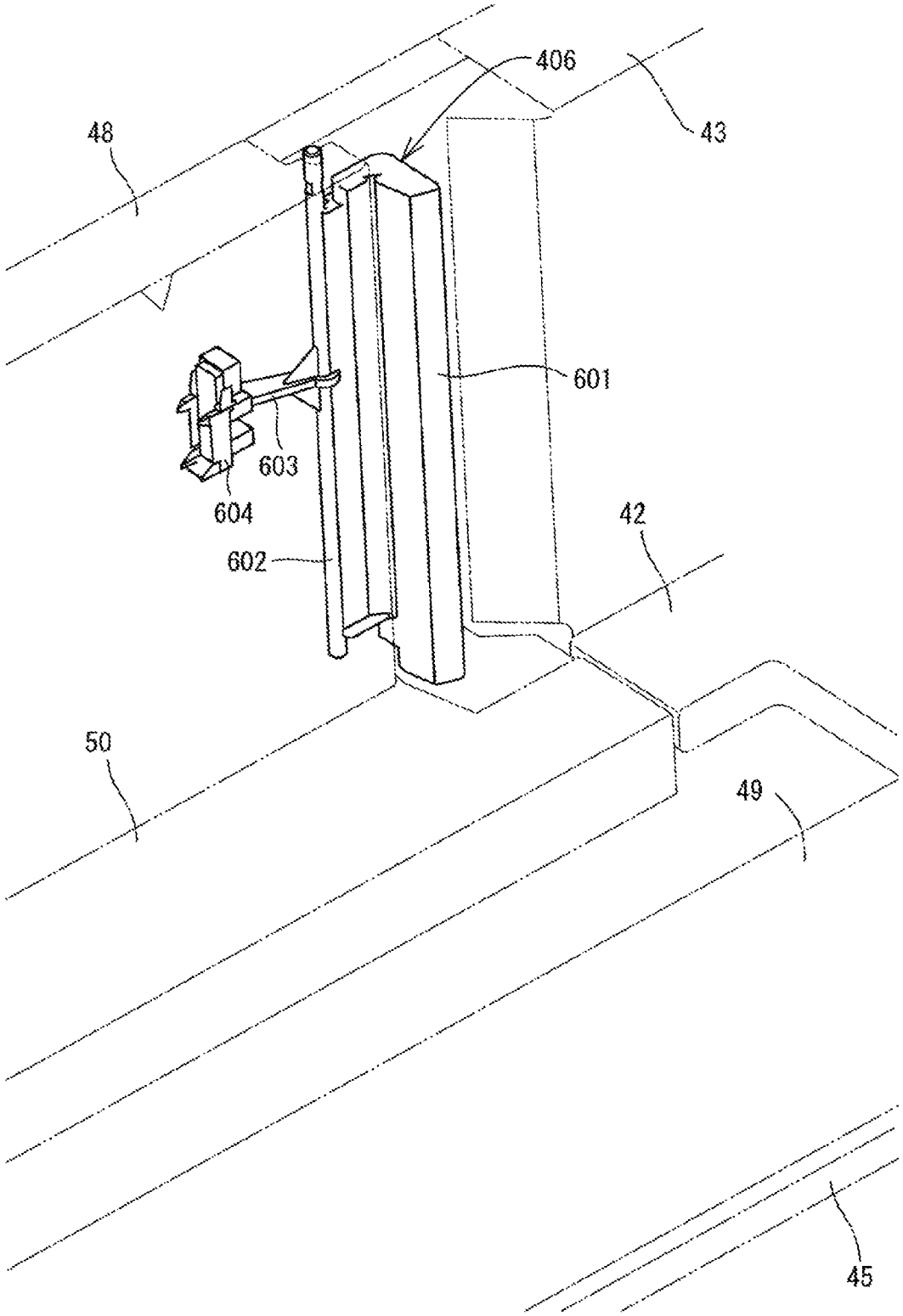
FIG. 10 is a perspective view illustrating the structure of a tilt detection sensor.

As illustrated in FIG. 10, the tilt detection sensor 406 includes the recording paper detection unit 601 which is provided between the regulation plate 43 and the regulation unit 48 and the tip of which projects into the casing 41, a vertical rotational shaft 602 which is supported by the regulation unit 48 to turn the recording paper detection unit 601, a light shielding plate 603 which is provided on the opposite side of the recording paper detection unit 601 about the center being the rotational shaft 602, and an optical switch (transmission sensor) 604 which is fixed inside the regulation unit 48 to let the light shielding plate 603 pass between the light receiving/emitting elements.

Figure 11B:
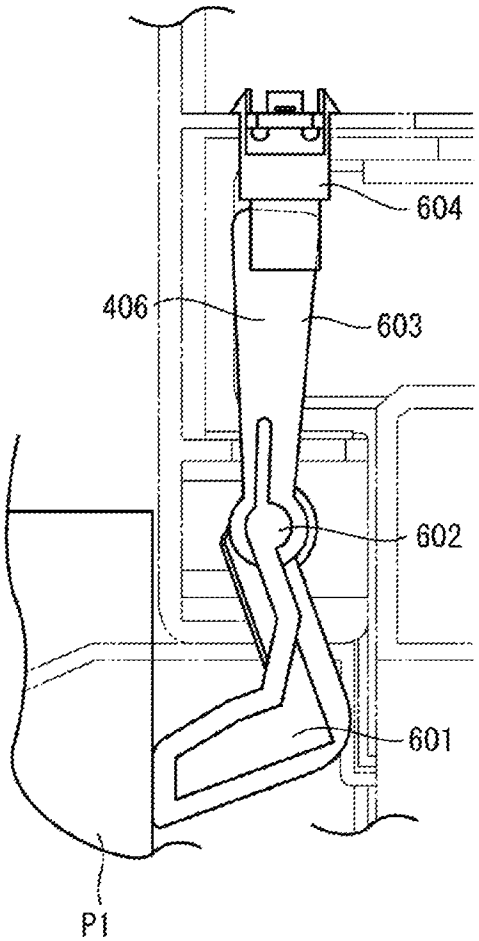
FIGS. 11A and 11B are plan views illustrating the operation of the tilt detection sensor, FIG. 11A illustrating a state when recording paper is loaded normally and FIG. 11B illustrating a state when a bundle of recording paper is tilted.
Figure 11A:
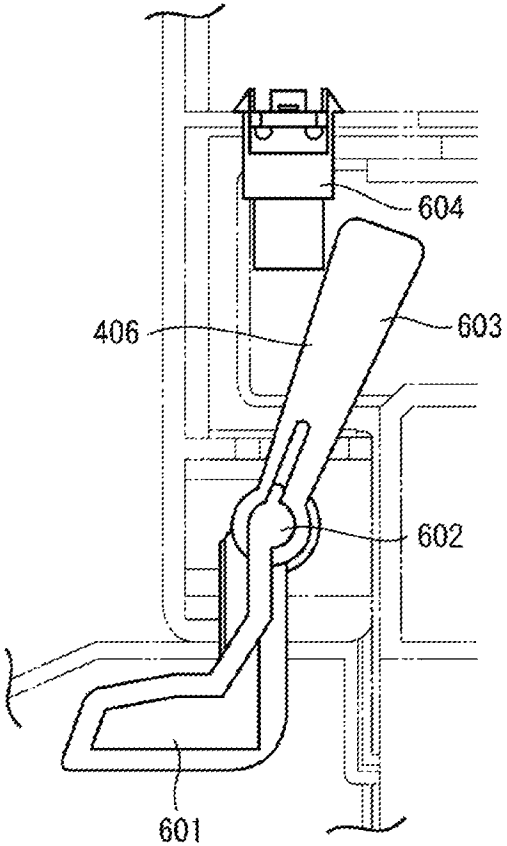

When the bundles of recording paper P11 and P12 in the first and second accommodation units 4A and 4B are not tilted, the recording paper detection unit 601 is not in contact with the recording paper P1 so that the tip of the recording paper detection unit 601 projects inside the casing 41, as illustrated in FIG. 11A. At this time, the light shielding plate 603 is positioned off the optical switch 604, whereby the optical switch 604 performs a light receiving/emitting operation and outputs an ON signal. That is, when the optical switch 604 of the tilt detection sensor 406 outputs the ON signal, the image forming apparatus 1 determines that both bundles of recording paper P11 and P12 are loaded normally.

Figure 12:
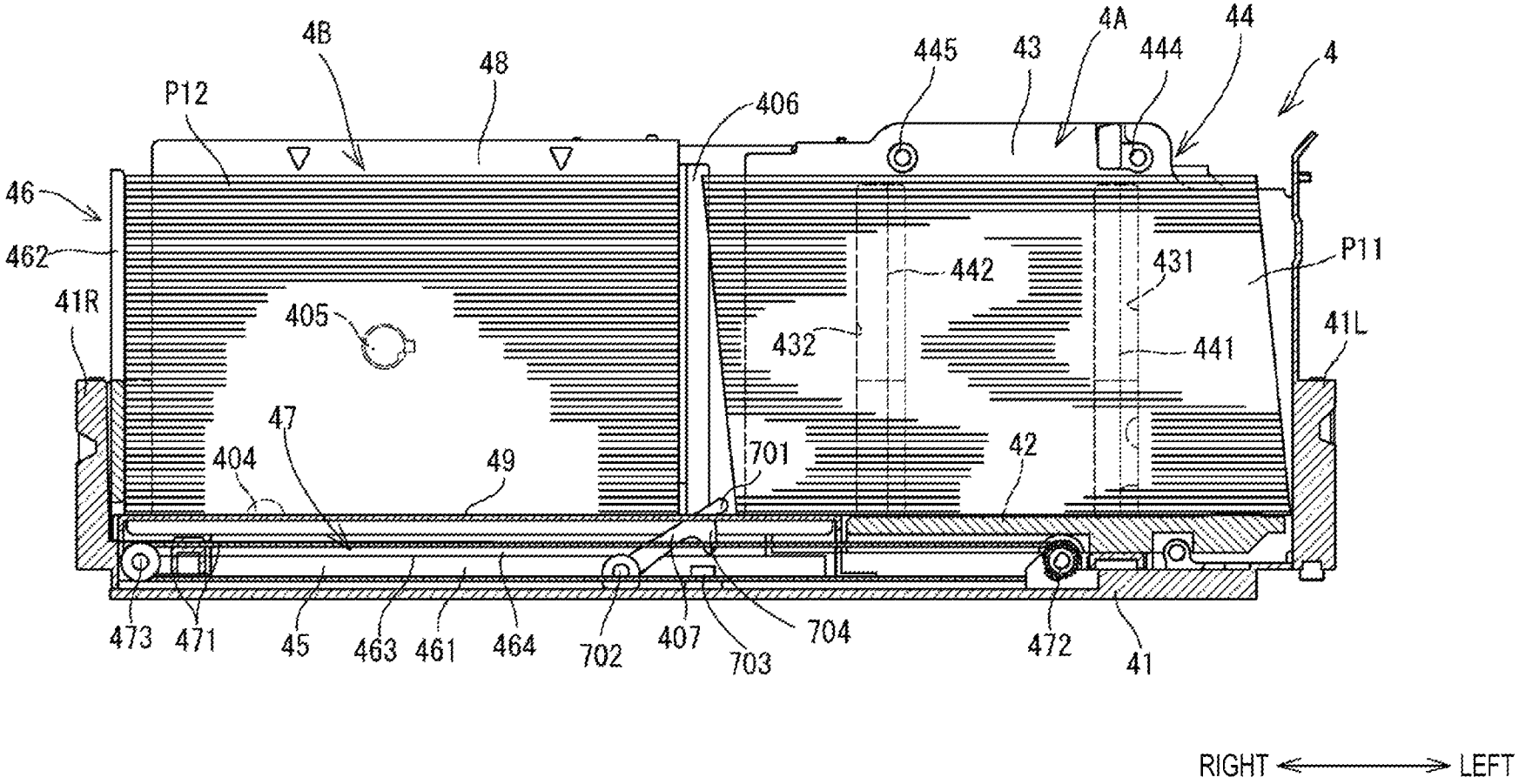
FIG. 12 is a cross-sectional view illustrating a state where a bundle of recording paper loaded in the paper feeder is tilted.

On the other hand, when either of the bundles of recording paper P11 and P12 is tilted as illustrated in FIG. 12 (FIG. 12 illustrates an example where the bundle of recording paper P11 is tilted), the recording paper detection unit 601 is brought into contact with the recording paper P1 and pushed outside the casing 41. At this time, as illustrated in FIG. 11B, the recording paper detection unit 601 turns about the rotational shaft 602, thereby causing the light shielding plate 603 integrated with the recording paper detection unit 601 to turn at the same time and overlap the optical switch 604. Accordingly, the light shielding plate 603 is positioned while overlapping the optical switch 604, so that the light receiving/emitting operation of the optical switch 604 is interrupted and that an OFF signal is output from the optical switch 604. That is, when the optical switch 604 of the tilt detection sensor 406 outputs the OFF signal, the image forming apparatus 1 determines that either of the bundles of recording paper P11 and P12 is tilted (the recording paper is loaded erroneously).

Figure 13:
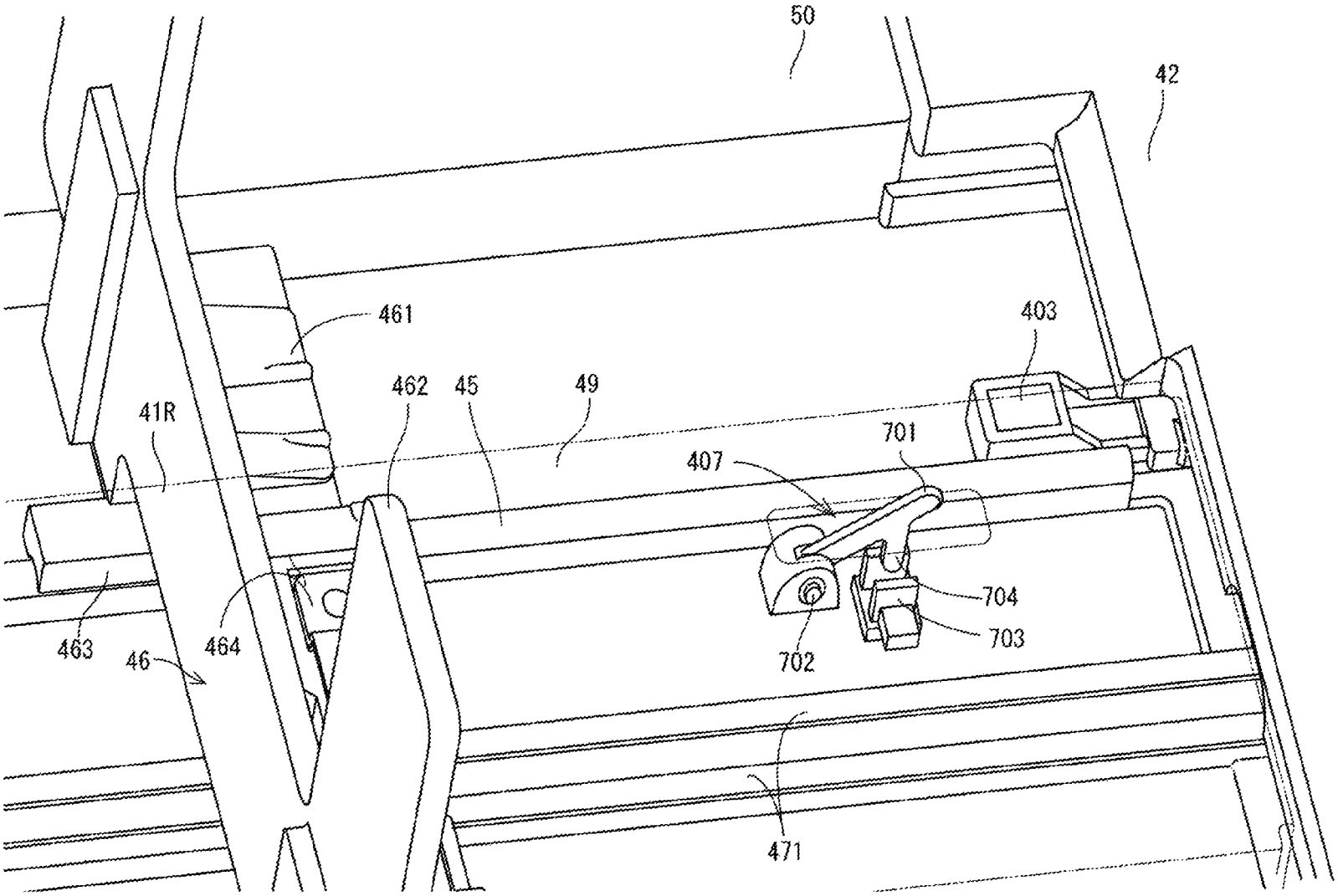
FIG. 13 is a perspective view illustrating the structure of an accommodation orientation detection sensor.

As illustrated in FIG. 13, the accommodation orientation detection sensor 407 includes the recording paper detection unit 701 which projects from the surface of the cover body 49, a rotational shaft 702 which is supported at the bottom of the cover body 49 to be able to sway the recording paper detection unit 701, and a switch 703 which is tuned ON/OFF by the swaying of the recording paper detection unit 701. In the present embodiment, there will be described an example where an optical switch is used as the switch 703, the optical switch causing a light shielding plate 704 interlocked with the rotational shaft 702 to pass between the light receiving/emitting elements. A contact switch instead of the optical switch may be used as the switch 703, the contact switch including a pushing member interlocked with the rotational shaft 702 and being turned ON/OFF when brought into contact with the pushing member.

Figure 14A:
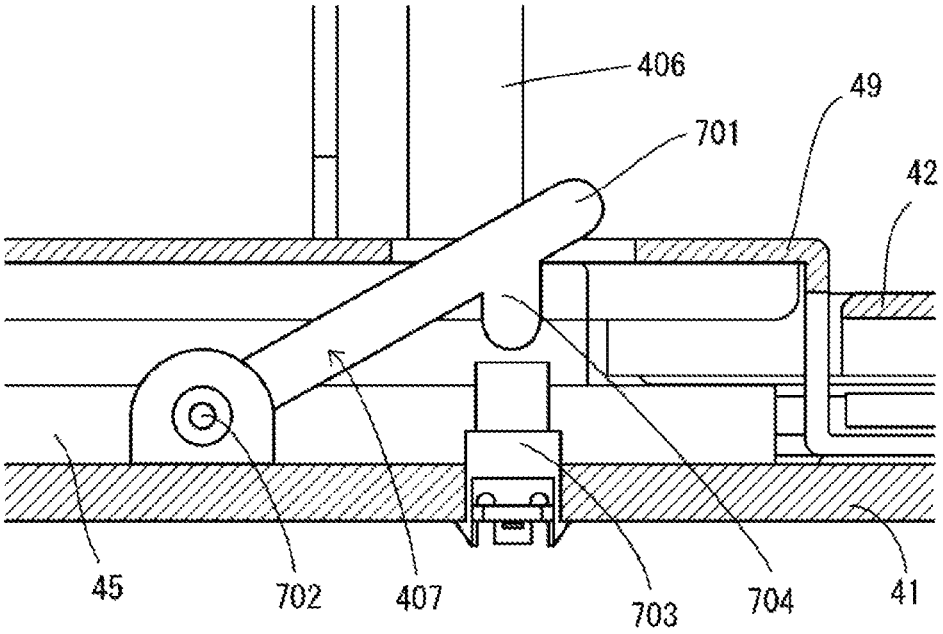
FIGS. 14A and 14B are side views illustrating the operation of the tilt detection sensor, FIG. 14A illustrating a state when recording paper is loaded normally and FIG. 14B illustrating a state when the recording paper is loaded in the erroneous loading region.

When the bundles of recording paper P11 and P12 are accommodated in the long edge feed orientation in the first and second accommodation units 4A and 4B, respectively, the recording paper P1 is not loaded in the non-loaded region R1 so that, as illustrated in FIG. 14A, the recording paper detection unit 701 is not pressed below the cover body 49. At this time, the light shielding plate 704 is positioned off the optical switch 703, whereby the optical switch 703 performs a light receiving/emitting operation and outputs an ON signal. That is, when the optical switch 703 of the accommodation orientation detection sensor 407 outputs the ON signal, the image forming apparatus 1 determines that both bundles of recording paper P11 and P12 are loaded normally.

Figure 14B:
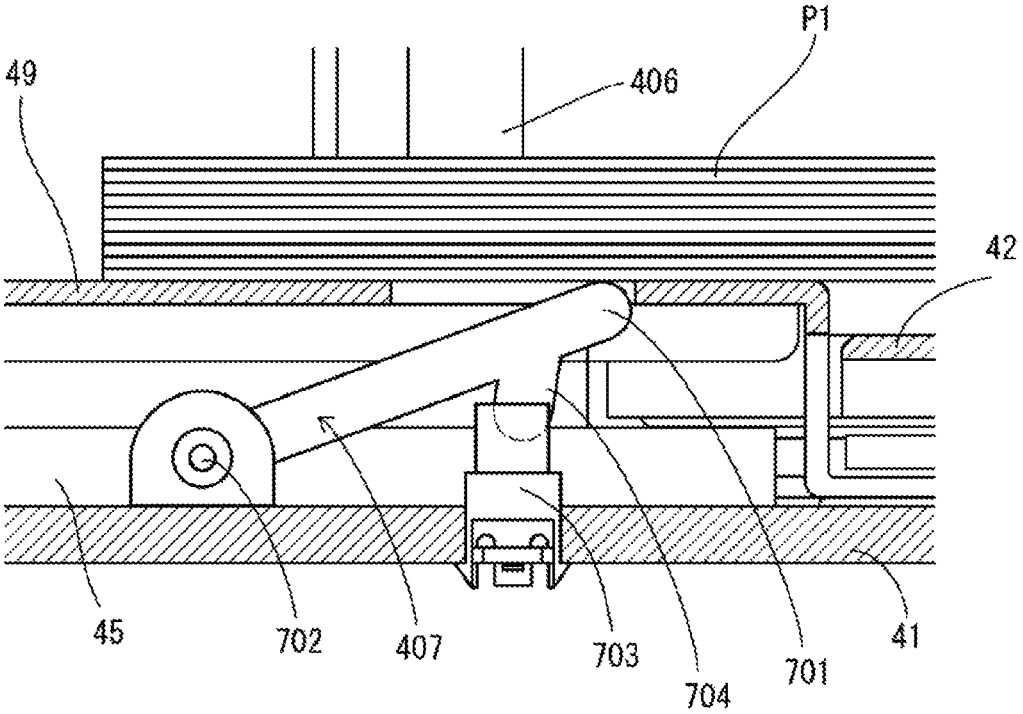

On the other hand, when the recording paper P1 is accommodated in an orientation such as the short edge feed orientation other than the long edge feed orientation in the paper feeder 4, the recording paper P1 is loaded in the non-loaded region R1 so that, as illustrated in FIG. 14B, the recording paper detection unit 701 is pressed below the cover body 49. At this time, as illustrated in FIG. 14B, the recording paper detection unit 701 turns about the rotational shaft 702, thereby causing the light shielding plate 704 integrated with the recording paper detection unit 701 to turn at the same time and overlap the optical switch 703. Accordingly, the light shielding plate 704 is positioned while overlapping the optical switch 703, so that the light receiving/emitting operation of the optical switch 703 is interrupted and that an OFF signal is output from the optical switch 703. That is, when the optical switch 703 of the accommodation orientation detection sensor 407 outputs the OFF signal, the image forming apparatus 1 determines that the accommodation orientation of the recording paper P1 in the paper feeder 4 is not the specified orientation (the recording paper is loaded erroneously).

The accommodation orientation detection sensor 407 is installed at a position in front of or behind the slide mechanism 47 to not overlap the slide mechanism 47. The shift plate 46 passes above the slide mechanism 47 when shifting the bundle of recording paper including the recording paper P1 to the ascending/descending plate 42 of the first accommodation unit 4A. At this time, the recording paper detection unit 701 is pressed by the base end portion 461 of the shift plate 46 and the recording paper P1, but the image forming apparatus 1 determines that a signal from the accommodation orientation detection sensor 407 is invalid (cancels the signal) while the recording paper P1 is being shifted.

Figure 15:
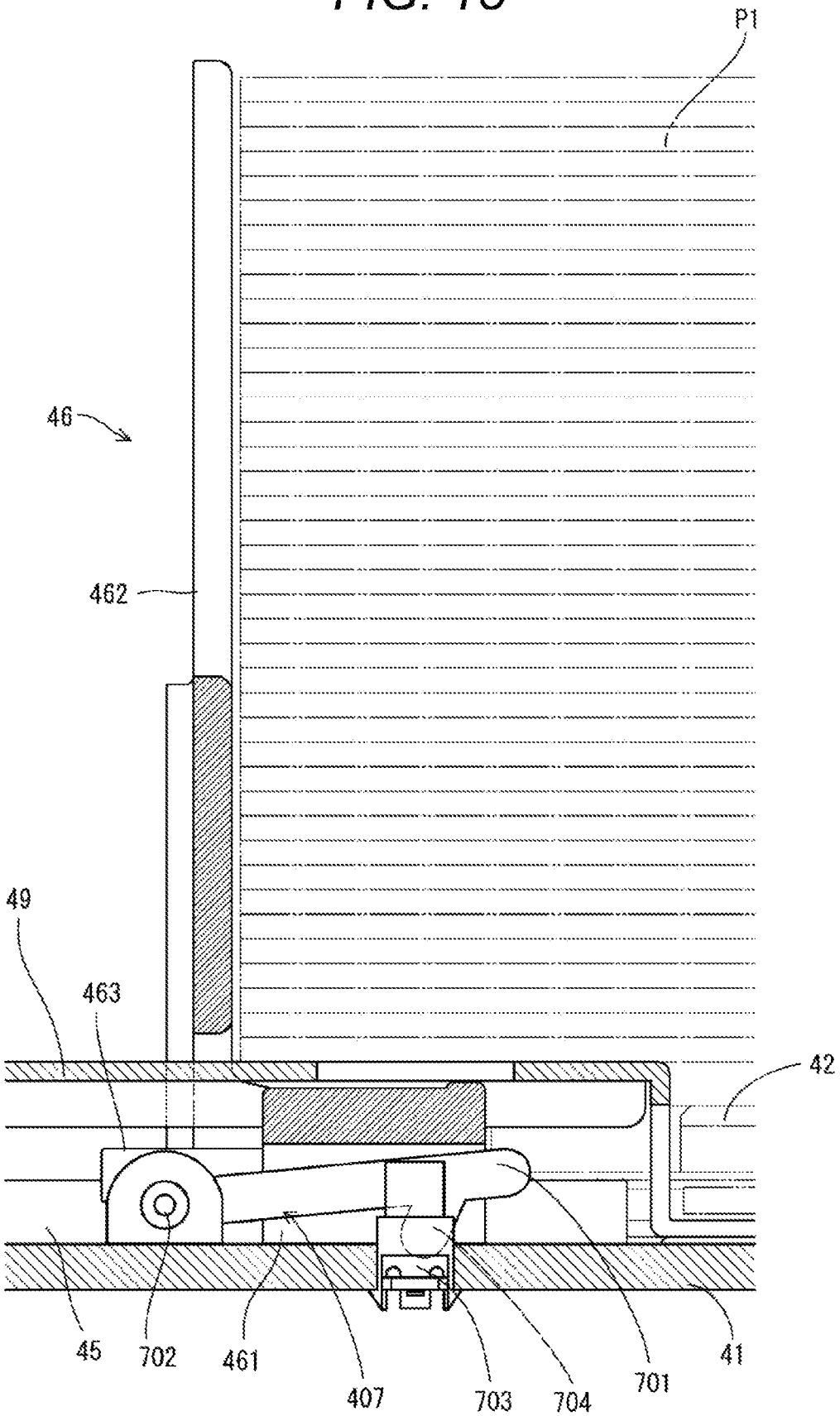
FIG. 15 is a side view illustrating a state of the accommodation orientation detection sensor when a shift plate passes thereover.

Moreover, as illustrated in FIG. 15, the accommodation orientation detection sensor 407 fixes the switch 703 and pivotally supports the recording paper detection unit 701 on the base plate side of the casing 41 so that, when the shift plate 46 passes above the accommodation orientation detection sensor 407 in shifting the recording paper P1, the shift plate 46 does not interfere with the base end portion 461. Furthermore, the recording paper detection unit 701 is pivotally supported to sway in a direction in which the recording paper P1 is moved when the recording paper P1 is shifted, whereby the accommodation orientation detection sensor 407 does not impede the movement of the recording paper P1, which can thus be shifted smoothly by the shift plate 46.

<Another Example of Structure of Accommodation Orientation Detection Sensor>

Figure 16:
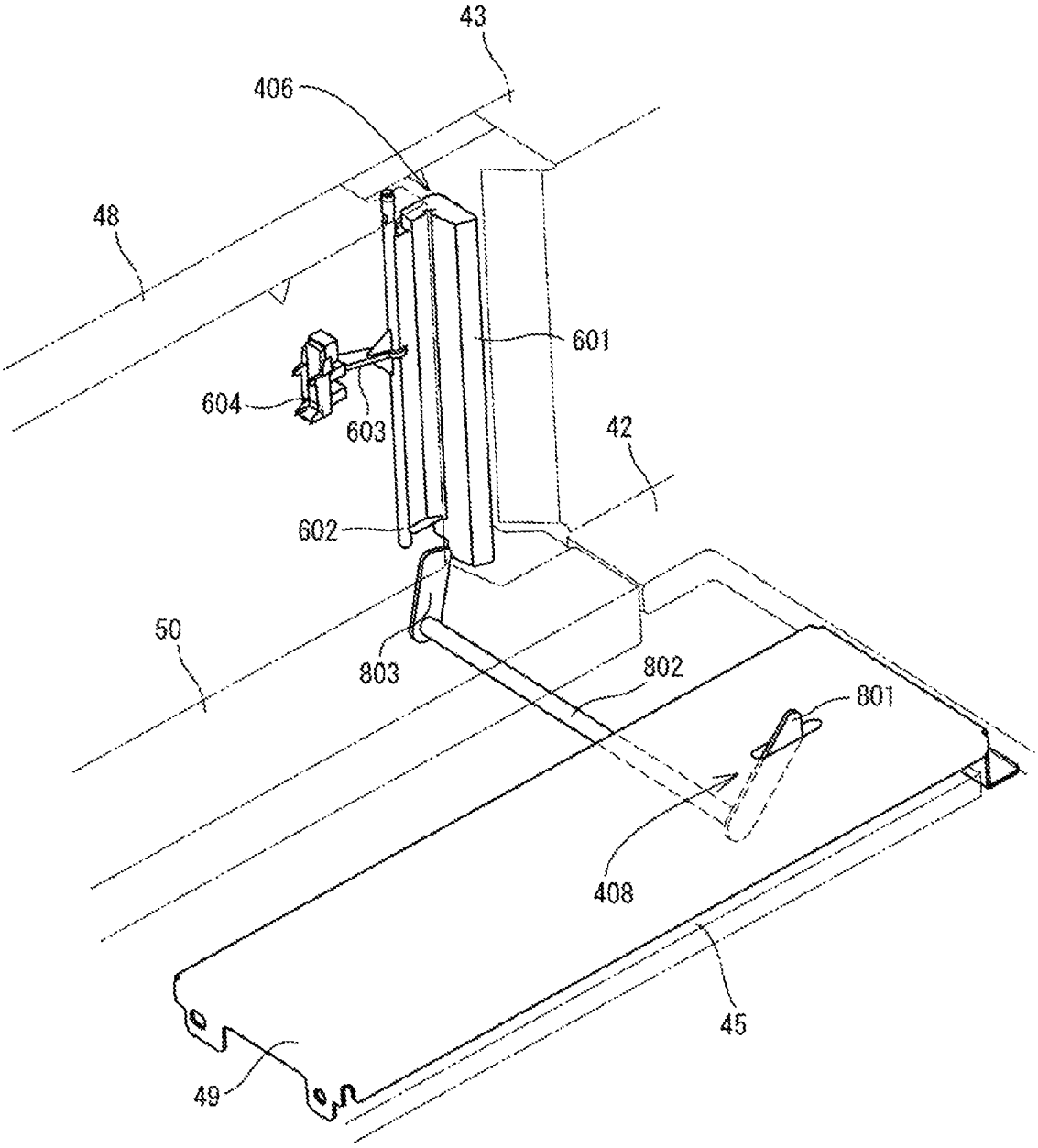
FIG. 16 is an external perspective view illustrating another example of a sensor detecting faulty accommodation (erroneous loading) of recording paper.

While the tilt detection sensor (second erroneous loading detection unit) 406 and the accommodation orientation detection sensor (first erroneous loading detection unit) 407 have been described as separate sensors in the aforementioned embodiment, a structural example described below illustrates the structure where a sensor switch is included only in the tilt detection sensor 406, and an accommodation orientation detection unit 408 working in cooperation with the tilt detection sensor 406 is provided in place of the accommodation orientation detection sensor 407. FIG. 16 is an external perspective view illustrating the structure of each of the accommodation orientation detection unit (first erroneous loading detection unit) and the tilt detection sensor (second erroneous loading detection unit) of the present example.

The accommodation orientation detection unit 408 in the present example includes a recording paper detection unit 801 projecting from the surface of the cover body 49, an interlocking shaft 802 which is supported under the cover body 49 as a rotational shaft of the recording paper detection unit 801 and extends to the tilt detection sensor 406, and a pushing member 803 which pushes the tilt detection sensor 406 by turning together with the interlocking shaft 802. That is, the accommodation orientation detection unit 408 is provided with the recording paper detection unit 801 at one end of the interlocking shaft 802 extending in the front-back direction, and the pushing member 803 at another end of the interlocking shaft 802. Such structure allows the tilt detection sensor 406 to be interlocked with the accommodation orientation detection unit 408. On the other hand, the accommodation orientation detection unit 408 can also allow the tilt detection sensor 406 to operate by itself without interlocked with the turning of the tilt detection sensor 406.

Figure 17:
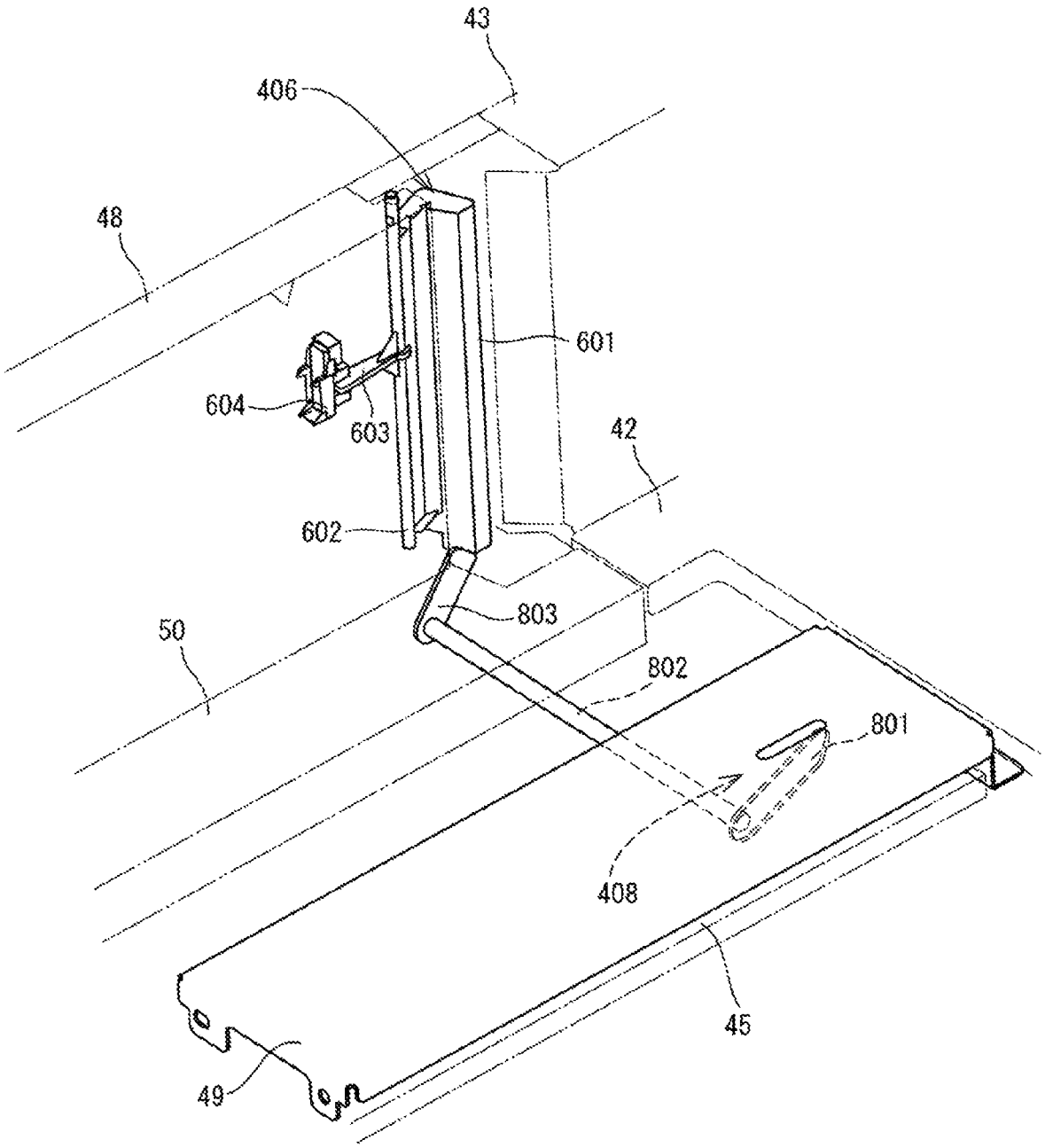
FIG. 17 is an external perspective view illustrating a state of a sensor when recording paper is not accommodated in a specified accommodation orientation.

The accommodation orientation detection unit 408 turns the pushing member 803 in response to the swaying of the recording paper detection unit 801, brings the pushing member 803 in contact with the tip of the recording paper detection unit 601 of the tilt detection sensor 406, and turns the tilt detection sensor 406. That is, when the recording paper P1 is accommodated in an orientation different from the specified accommodation orientation (long edge feed orientation), the recording paper P1 comes in contact with the recording paper detection unit 801 so that the accommodation orientation detection unit 408 turns about the interlocking shaft 802. Accordingly, as illustrated in FIG. 17, the pushing member 803 is tilted with the swaying of the recording paper detection unit 801 in the accommodation orientation detection unit 408. The recording paper detection unit 601 of the tilt detection sensor 406 is thus turned by the pushing member 803 of the accommodation orientation detection unit 408. Therefore, the light shielding plate 603 is moved to a position overlapping the optical switch 604, from which the OFF signal is output.

Figure 18C:
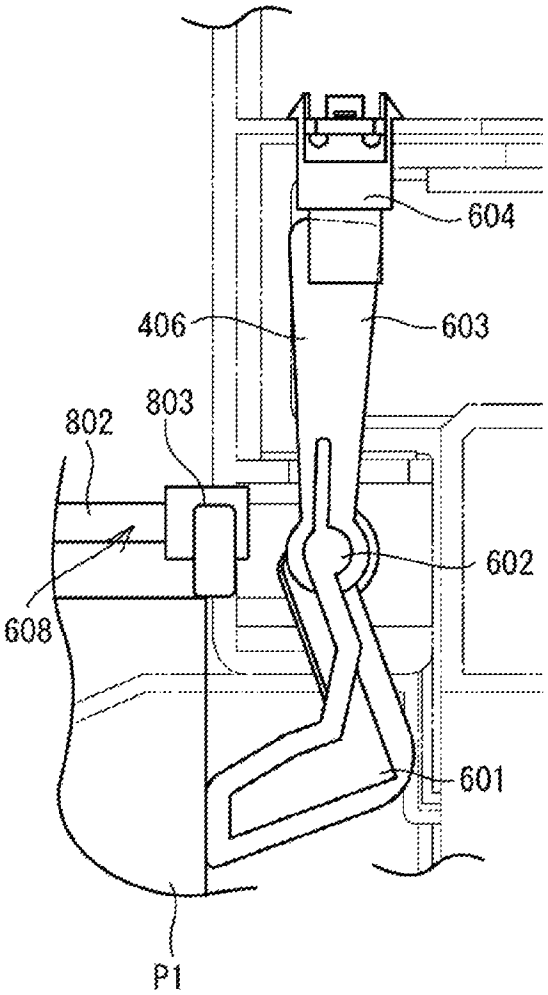
FIGS. 18A to 18C are plan views illustrating the operation of the tilt detection sensor, FIG. 18A illustrating a state when recording paper is loaded normally, FIG. 18B illustrating a state when the recording paper is loaded in the erroneous loading region, and FIG. 18C illustrating a state when a bundle of recording paper is tilted.
Figure 18B:
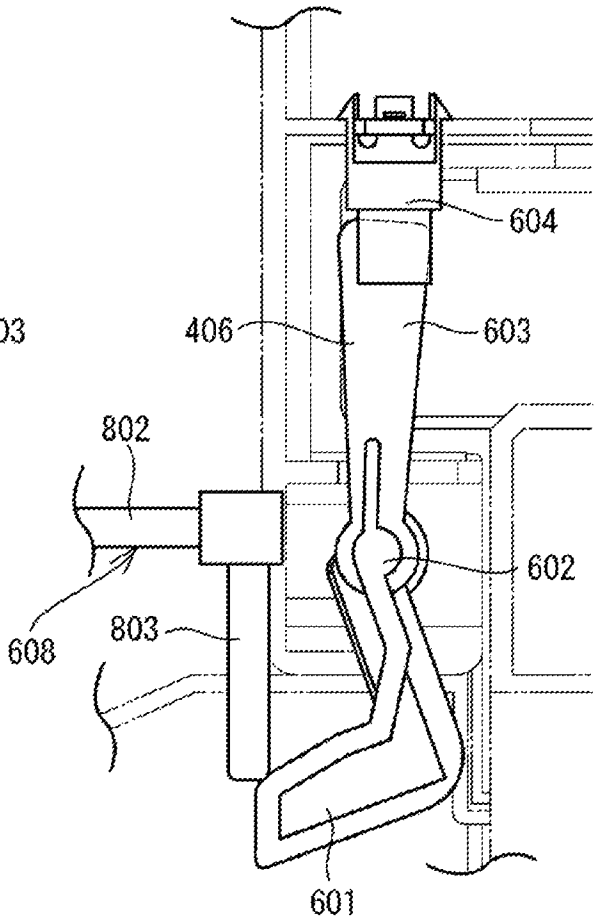
Figure 18A:
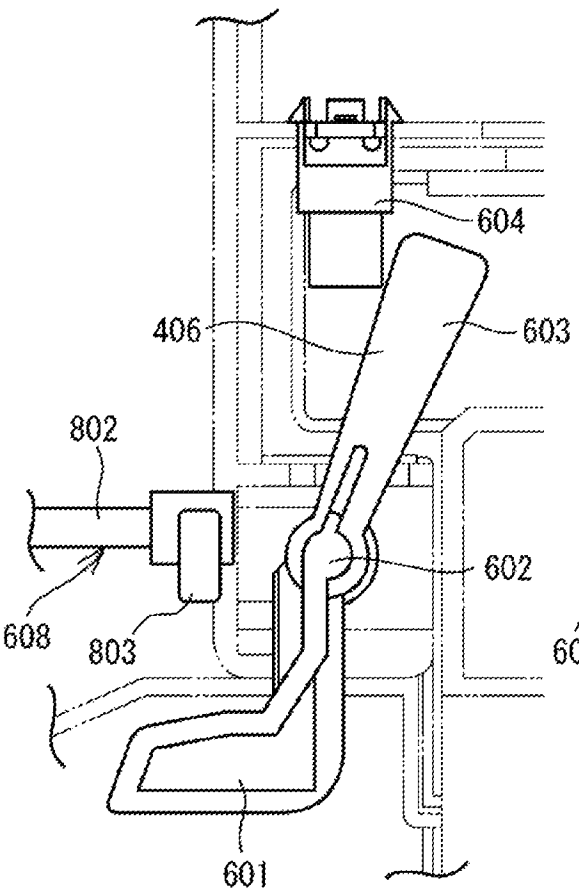

When the bundles of recording paper P11 and P12 are accommodated in the long edge feed orientation in the first and second accommodation units 4A and 4B, respectively, the recording paper detection unit 801 is not pressed under the cover body 49 as illustrated in FIG. 16, so that the accommodation orientation detection unit 408 does not turn. Here, when neither of the bundles of recording paper P11 and P12 is tilted, the light shielding plate 603 of the tilt detection sensor 406 does not overlap with the optical switch 604 as illustrated in FIG. 18A, so that the ON signal is output from the optical switch 604. The image forming apparatus 1 therefore determines that the recording paper P1 is accommodated in the long edge feed orientation without being tilted in each of the first and second accommodation units 4A and 4B of the paper feeder 4.

On the other hand, when the recording paper P1 is accommodated in an orientation such as the short edge feed orientation other than the long edge feed orientation in the paper feeder 4, the recording paper detection unit 701 is pressed under the cover body 49 as illustrated in FIG. 15 so that the accommodation orientation detection unit 408 is turned. Accordingly, as illustrated in FIG. 18B, the pushing member 803 of the accommodation orientation detection unit 408 pushes the right side of the tip of the recording paper detection unit 601 of the tilt detection sensor 406, which is then turned. The light shielding plate 603 of the tilt detection sensor 406 thus overlaps with the optical switch 604, from which the OFF signal is output.

When either of the bundles of recording paper P11 and P12 loaded in the first and second accommodation units 4A and 4B is tilted, the recording paper P1 is brought into contact with the front side of the tip of the recording paper detection unit 601 of the tilt detection sensor 406, whereby the recording paper detection unit 601 is pushed outside the casing 41. Accordingly, as illustrated in FIG. 18C, the tilt detection sensor 406 is turned so that the light shielding plate 603 thereof overlaps with the optical switch 604, from which the OFF signal is output.

The OFF signal is output from the optical switch 604 of the tilt detection sensor 406 when the accommodation orientation of the recording paper P1 is different from the specified orientation or when the recording paper P1 is loaded while being tilted. Therefore, the image forming apparatus 1 determines that there is a problem with the accommodated state of the recording paper P1 in the paper feeder 4 and displays, on the operation panel 9 or the like, that re-accommodation of the recording paper P1 into the paper feeder 4 is requested to be able to notify a user of the abnormality regarding the accommodated state of the recording paper P1 (erroneous loading of the recording paper).

As described above, the present example is configured to operate the tilt detection sensor 406 and the accommodation orientation detection unit 408 in cooperation with each other so that the sensor switch need be provided only in the tilt detection sensor 406. As a result, not only the number of sensors but the number of wirings such as the signal wires of the sensor can be reduced in the paper feeder 4, whereby the space inside the device can be constructed effectively.

While the image forming apparatus employing the electrophotographic method has been described as an example of the image forming apparatus according to the invention of the present application, an image forming apparatus employing another method other than the electrophotographic method such as an inkjet method may be adopted as long as the paper feeder and the paper feeding mechanism described in each of the aforementioned embodiments are included. Moreover, an MFP (Multifunction Peripheral) having a copy function, a scanner function, a printer function and a facsimile function, a printer, a copying machine, and a facsimile machine may be adopted as the image forming apparatus according to the invention of the present application as long as the paper feeder and the paper feeding mechanism described in each of the aforementioned embodiments are included. In addition, the configuration of each unit is not limited to what is illustrated in the embodiments, where various modifications can be made without departing from the scope of the invention of the present application.

According to an embodiment of the present invention, the faulty accommodation (erroneous loading) of the recording paper can be surely detected in the paper feeder which can accommodate the large volume of recording paper by placing two bundles of recording paper side by side in the conveyance direction. As a result, the recording paper loaded in the orientation other than the specified accommodation orientation can be detected, the accommodation capacity of the recording paper within the paper feeder can be set to the maximum, and the number of times the recording paper is replaced can be reduced. Moreover, the tilt of the bundle of recording paper can be detected to be able to prevent erroneous feeding of the recording paper from the paper feeder. Furthermore, the accommodation orientation of the recording paper can be detected in conjunction with the detection of the tilt of the bundle of recording paper, whereby only one sensor switch need be provided to be able to reduce the number of components and wirings.

Although the present invention has been described and illustrated in detail, it is clearly understood that the same is by way of illustrated and example only and is not to be taken by way of limitation, the scope of the present invention being interpreted by terms of the appended claims.

What is claimed is:

1. A paper feeder comprising:

first and second accommodation units which are arranged side by side in a casing along a recording paper conveyance direction and in which recording paper is loaded in a specified accommodation orientation corresponding to an orientation in which a short-edge side of the recording paper is parallel to the recording paper conveyance direction; and a first erroneous loading detection unit detecting recording paper accommodated in an orientation other than the specified accommodation orientation, the first erroneous loading detection unit being provided in an erroneous loading region which is located in a non-loaded region provided between the first and second accommodation units, wherein the paper feeder can shift a bundle of the recording paper loaded in the second accommodation unit to the first accommodation unit arranged on a downstream side of the recording paper conveyance direction, the first accommodation unit includes an ascending/descending plate onto which the recording paper is loaded and a lift mechanism which moves up/down the ascending/descending plate, the second accommodation unit includes a shift plate which shifts a bundle of loaded recording paper toward the ascending/descending plate of the first accommodation unit and a slide mechanism which slides the shift plate, the erroneous loading region is only provided in an overlap region which is a region configured such that, when a pair of sheets of paper, which are rectangular and which do not overlap and do not extend outside the first and second accommodation units when they are provided in the specified accommodation orientation and in opposite corners of the first and second accommodation units, are provided in the orientation other than the specified accommodation orientation and in the opposite corners of the first and second accommodation units, the pair of sheets of paper overlap in the overlap region.

2. The paper feeder according to claim 1, wherein the paper feeder further comprises a second erroneous loading detection unit provided on a side wall of the casing.

3. The paper feeder according to claim 2, wherein the first erroneous loading detection unit is configured to be able to operate in conjunction with the second erroneous loading detection unit, the second erroneous loading detection unit includes a sensor switch which outputs a detection result, and when the first erroneous loading detection unit detects faulty accommodation of the recording paper, the second erroneous loading detection unit is operated in conjunction to cause the sensor switch to output a signal indicating the faulty accommodation.

4. The paper feeder according to claim 1, wherein the lift mechanism moves up the ascending/descending plate to allow the recording paper loaded in the first accommodation unit to be conveyed, and when all the recording paper loaded in the first accommodation unit is conveyed, the lift mechanism moves down the ascending/descending plate, and then the slide mechanism moves the shift plate toward the ascending/descending plate to shift the bundle of recording paper loaded in the second accommodation unit to the first accommodation unit.

5. An image forming apparatus comprising:

the paper feeder according to claim 1 which can be inserted/drawn into/from the apparatus;

a paper feeding mechanism which extracts recording paper stored in a fed paper storage unit; and an image forming unit which forms an image on the recording paper extracted by the paper feeding mechanism.

6. The paper feeder according to claim 2, wherein the erroneous loading region is located on a diagonal line formed by most far corners among corners of the first and second accommodation units.

7. The paper feeder according to claim 1, wherein the first erroneous loading detection unit projects upward from a bottom face of the casing and is configured to sway downward by weight of paper on the bottom face.

8. The paper feeder according to claim 1, wherein the first erroneous loading detection unit is pivotally supported to sway in a direction in which the recording paper is moved when the recording paper is shifted.

9. A paper feeder comprising:

first and second accommodation units which are arranged side by side in a casing along a recording paper conveyance direction and in which recording paper is loaded in a specified accommodation orientation corresponding to an orientation in which a short-edge side of the recording paper is parallel to the recording paper conveyance direction;

a first erroneous loading detection unit detecting recording paper accommodated in an orientation other than the specified accommodation orientation, the first erroneous loading detection unit being provided in an erroneous loading region which is located in a non-loaded region provided between the first and second accommodation units; and a second erroneous loading detection unit provided on a side wall of the casing, wherein the paper feeder can shift a bundle of the recording paper loaded in the second accommodation unit to the first accommodation unit arranged on a downstream side of the recording paper conveyance direction, the first accommodation unit includes an ascending/descending plate onto which the recording paper is loaded and a lift mechanism which moves up/down the ascending/descending plate, the second accommodation unit includes a shift plate which shifts a bundle of loaded recording paper toward the ascending/descending plate of the first accommodation unit and a slide mechanism which slides the shift plate, the erroneous loading region is only provided in an overlap region which is a region configured such that, when a pair of sheets of paper, which are rectangular and which do not overlap and do not extend outside the first and second accommodation units when they are provided in the specified accommodation orientation and in opposite corners of the first and second accommodation units, are provided in the orientation other than the specified accommodation orientation and in the opposite corners of the first and second accommodation units, the pair of sheets of paper overlap in the overlap region.

10. The paper feeder according to claim 9, wherein the first erroneous loading detection unit is configured to be able to operate in conjunction with the second erroneous loading detection unit, the second erroneous loading detection unit includes a sensor switch which outputs a detection result, and when the first erroneous loading detection unit detects faulty accommodation of the recording paper, the second erroneous loading detection unit is operated in conjunction to cause the sensor switch to output a signal indicating the faulty accommodation.

11. The paper feeder according to claim 9, wherein the erroneous loading region is located on a diagonal line formed by most far corners among corners of the first and second accommodation units.

12. The paper feeder according to claim 9, wherein the first erroneous loading detection unit projects upward from a bottom face of the casing and is configured to sway downward by weight of paper on the bottom face.

13. The paper feeder according to claim 9, wherein the first erroneous loading detection unit is pivotally supported to sway in a direction in which the recording paper is moved when the recording paper is shifted.

* * * * *